US007773932B2

(12) United States Patent
Katano et al.

(10) Patent No.: US 7,773,932 B2
(45) Date of Patent: Aug. 10, 2010

(54) FIXATION DEVICE, FIXATION METHOD, IMAGE FORMING APPARATUS, IMAGE FORMING METHOD AND FIXATION FLUID

(75) Inventors: Yasuo Katano, Kanagawa (JP); Tsuneo Kurotori, Tokyo (JP); Tomoyasu Hirasawa, Tokyo (JP); Takuma Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 488 days.

(21) Appl. No.: 11/896,328

(22) Filed: Aug. 31, 2007

(65) Prior Publication Data

US 2008/0063446 A1 Mar. 13, 2008

(30) Foreign Application Priority Data

Aug. 31, 2006 (JP) ..... 2006-234735

(51) Int. Cl.
*G03G 15/20* (2006.01)

(52) U.S. Cl. ..... 399/340

(58) Field of Classification Search ..... 399/340; 430/124.21, 104

See application file for complete search history.

(56) References Cited

U.S. PATENT DOCUMENTS 5,666,628 A * 9/1997 Fukai ..... 399/340
2005/0254867 A1* 11/2005 Kurotori et al. ..... 399/340
2006/0115762 A1* 6/2006 Katano et al. ..... 430/124
2007/0231027 A1* 10/2007 Kamei et al. ..... 399/329

FOREIGN PATENT DOCUMENTS

| | | |
|---|---|---|
| JP | 52-006531 | 1/1977 |
| JP | 59-119364 | 7/1984 |
| JP | 03-257473 | 11/1991 |
| JP | 07-072748 | 3/1995 |
| JP | 2001-188426 | 7/2001 |
| JP | 3290513 | 3/2002 |
| JP | 2004-109747 | 4/2004 |
| JP | 2004-109749 | 4/2004 |

* cited by examiner

*Primary Examiner*—David M Gray
*Assistant Examiner*—G. M. Hyder
(74) *Attorney, Agent, or Firm*—Harness, Dickey & Pierce, PLC

(57) ABSTRACT

A fixation device configured to fix on a medium a resin fine particle that contains a resin, by providing a fixation fluid on the resin fine particle on the medium which fixation fluid contains a softening agent that softens the resin fine particle by dissolving or swelling at least one portion of the resin, water and a foaming agent that comprises a salt of aliphatic acid, wherein the fixation device comprises a foam-like fixation fluid producing part configured to produce a foam-like fixation fluid, a layer thickness controlling part configured to control a layer thickness of the produced foam-like fixation fluid, and a provision part configured to provide the layer-thickness-controlled foam-like fixation fluid on the resin fine particle on the medium.

20 Claims, 15 Drawing Sheets

FIXATION DEVICE, FIXATION METHOD, IMAGE FORMING APPARATUS, IMAGE FORMING METHOD AND FIXATION FLUID

BACKGROUND OF THE INVENTION

1. Field of the Invention

The present invention relates to a fixation device, a fixation method, an image forming apparatus, an image forming method and a fixation fluid.

2. Description of the Related Art

An image forming apparatus such as a printer, a facsimile machine and a copying machine is an apparatus for forming an image containing a character or a symbol on a recording medium such as paper, cloth and OHP sheets, based on image information. Particularly, an electrophotographic image forming apparatus has widely been used in offices since a highly fine image may be formed on a normal paper sheet at a high speed. In such an electrophotograhpic image forming apparatus, a thermal fixation process has widely been used in which toner is fixed on a recording medium by heating and fusing the toner on the recording medium and applying a pressure on the fused toner. The thermal fixation process has preferably been used since a high fixation speed and a high fixed-image quality may be provided.

However, a half or more of electric power consumed in such an electrophotographic image forming apparatus is used for heating toner in the thermal fixation process. On the other hand, a fixation device with low electric power consumption (energy saving) is desired from the viewpoint of dealing with environmental problems in recent years. That is, it is desired to extremely lower the temperature of heating of toner to fix the toner more than ever before, or to provide a fixation method which does not require toner heating. Particularly, a non-heating fixation method for fixing toner on a recording medium while no toner is heated at all is ideal in view of the low electric power consumption.

For such a non-heating fixation method, for example, Japanese Patent No. 3,290,513 suggests a wet-type toner fixation method which includes spraying or dropping an oil-in-water-type fixing agent in which an organic compound being capable of dissolving or swelling toner and insoluble or difficult to dissolve in water is dispersed and mixed in water, onto unfixed toner provided at a predetermined position on a surface of a substrate so as to dissolve or swell the toner, and subsequently drying the substrate.

However, since the oil-in-water-type fixing agent in which an organic compound being insoluble or difficult to dissolve in water is dispersed and mixed in water is used in the wet-type fixation method disclosed in Japanese Patent No. 3,290,513, a recording medium (substrate) such as a transcription paper sheet may absorb the water and thereby cockling or curling may occur on the recording medium when a large amount of the fixing agent is provided to unfixed toner. Accordingly, stable and high speed conveyance of a recording medium which is required for an image forming apparatus may be significantly disturbed. Herein, if the water is removed from the fixing agent provided on the recording medium by evaporating a large amount of water contained in the fixing agent using a dryer, a electric power would be required which is comparable with the electric power consumption of an image forming apparatus using a thermal fixation process.

Furthermore, for a fixation liquid which does not repel water-repellent treated and unfixed toner, some oily fixation liquids have conventionally been suggested in which a material for dissolving or swelling toner is dissolved in an oily solvent. For one example of them, for example, Japanese Patent Application Publication No. 2004-109749 suggests a fixation liquid in which, for example, an aliphatic dibasic acid ester as a material component for dissolving or swelling a resin component constituting toner is diluted (dissolved) in non-volatile dimethylsilicone as a diluent (solvent). Also, Japanese Patent Application Publication No. 59-119364 suggests a solution for fixing an unfixed toner image which may be used for a fixation method capable of fixing an unfixed image formed by an electrostatic method on an image-receiving sheet sharply and easily without causing an image irregularity, wherein 100 parts by volume of a solvent dissolving toner and having a compatibility with a silicone oil is compatibly mixed with 8-120 parts by volume of a silicone oil. Such oily fixation liquids may dissolve or swell toner without repel water-repellent treated and unfixed toner and fix the toner on a recording medium since an oily solvent having high affinity with the water-repellent treated and unfixed toner is contained.

Each of Japanese Patent Application Publication Nos. 2004-109749 and 59-119364 discloses a configuration for providing a liquid onto unfixed toner. However, as shown in FIG. 17A, when the thickness of a fixation liquid layer 4 on an application roller 1 as a contact provision part is less than that of an unfixed toner layer 3 on a recording medium 2 in a configuration such that a fixation liquid is applied onto the unfixed toner layer 3 using the application roller 1, unfixed toner particles may be attracted by the surface tension of the fixation liquid layer on the surface of the application roller 1 at a position at which the application roller 1 moves away from the recording medium 2 and the toner particles may offset onto the application roller 1, whereby many irregularities may be caused on an image on the recording medium 2.

On the other hand, as shown in FIG. 17B, when the thickness of a fixation liquid layer 4 on an application roller 1 is sufficiently greater than that of an unfixed toner layer 3, the surface tension of the liquid layer on the surface of the application roller 1 may become not easy to act on toner particles directly and the toner may become not easy to offset onto the roller, at a position at which the application roller 1 moves away from a recording medium 2 because of a large amount of the liquid. However, since a large amount of the fixation liquid is applied on the paper surface, the toner particles may be carried away on the recording medium 2 due to an excess of the fixation liquid so as to cause degradation of image quality or a drying time period may become longer so as to cause a problem in the fixation responsibility. Also, significant residual liquid feeling (wet feeling obtained when a hand contacts a paper sheet) may be caused on the paper sheet. Furthermore, when the fixation liquid contains water and the amount of application onto a cellulose-containing medium such as a paper sheet is large, the recording medium such as a paper sheet may significant curl and jam of a paper sheet may occur at the time of conveyance of a recording medium such as a paper sheet in an apparatus such as an image forming apparatus. Thus, in the configuration of conducting roller application with such a fixation liquid, it may be very difficult to attain both application of a small amount of a fixation liquid onto a toner layer on a paper sheet for improvement of fixation responsibility, reduction of residual liquid feeling and prevention of curling, and prevention of toner offset onto a fixation roller. Also, when a die coat device, a blade application device, or a wire bar application device are used for a contact application part, toner may offset on the contact application part due to the surface tension of a fixation liquid in the case of a small amount thereof.

As described above, it may be very difficult to attain both application of a small amount of a fixation liquid onto a toner layer on a paper sheet for improving fixation responsibility and uniform application without causing an irregularity of a toner image, by the contact application part and the conventional formulation of a fixation liquid.

SUMMARY OF THE INVENTION

According to one aspect of the present invention, there is provided a fixation device configured to fix on a medium a resin fine particle that contains a resin, by providing a fixation fluid on the resin fine particle on the medium which fixation fluid contains a softening agent that softens the resin fine particle by dissolving or swelling at least one portion of the resin, water and a foaming agent that comprises a salt of aliphatic acid, wherein the fixation device comprises a foam-like fixation fluid producing part configured to produce a foam-like fixation fluid, a layer thickness controlling part configured to control a layer thickness of the produced foam-like fixation fluid, and a provision part configured to provide the layer-thickness-controlled foam-like fixation fluid on the resin fine particle on the medium.

According to another aspect of the present invention, there is provided an image forming apparatus which comprises an image forming part configured to form an unfixed toner image on a medium by conducting an electrostatic recording process with a toner in which a resin fine particle contains a coloring agent, and a fixation part configured to fix the unfixed toner image on the medium, with the fixation device as described above.

According to another aspect of the present invention, there is provided a fixation fluid configured to fix a resin fine particle on a medium by producing the fixation fluid in a foam-like condition and providing the produced foam-like fixation fluid on the resin fine particle on the medium, the fixation fluid contains a softening agent that softens the resin fine particle by dissolving or swelling at least one portion of the resin fine particle, water and a foaming agent that comprises a salt of aliphatic acid.

DETAILED DESCRIPTION OF THE PREFERRED EMBODIMENTS

The preferred embodiments of the present invention are described below, with reference to the accompanying drawings.

Figure 1:
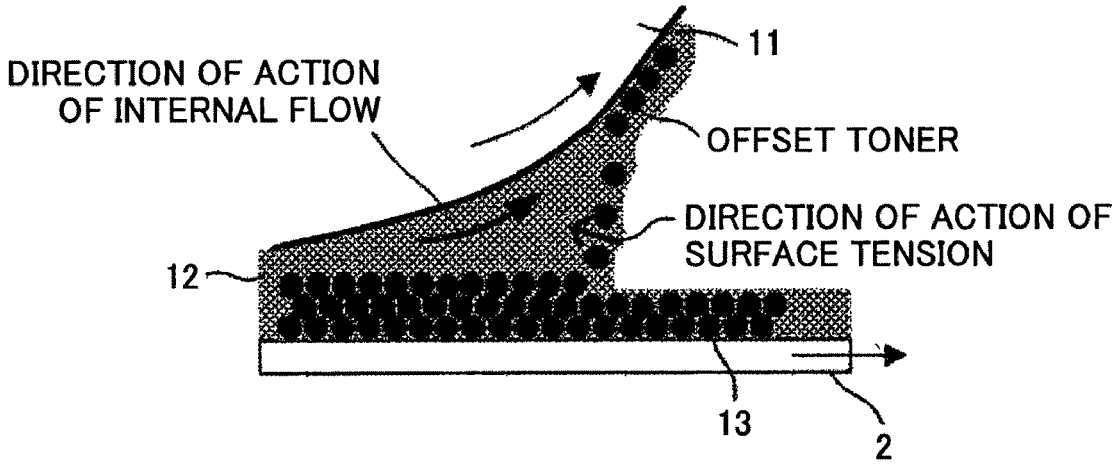
FIG. 1 is a conceptual diagram showing force acting on toner on the contact area between an application roller and a paper sheet.

FIG. 1 is a conceptual diagram showing force acting on toner at a contact area between an application roller and a paper sheet. As shown in the figure, when a fixation fluid 12 is in a liquid phase, the fluid surface of the fixation fluid 12 on an application roller 11 is provided with a strong surface tension along the roller surface. Furthermore, an internal flow in a direction of roller movement occurs in an internal portion of a fixation fluid layer on the application roller 11. Accordingly, when the thickness of the fixation fluid layer on the application roller 11 is comparable with that of a toner layer or thinner layer, a surface tension acts strongly such that unfixed toner particles 13 are attracted to the surface of the application roller 11 and the internal flow of the fluid also acts such that toner is conveyed along the roller surface, whereby the unfixed toner is retained on the application roller 11 and toner offset is caused. As the thickness of the fixation fluid layer on the application roller 11 is twice or more than twice that of the toner layer, the surface tension or internal flow of the liquid tends to hardly influence the toner, and therefore, when the thickness of the fixation fluid layer on the application roller 11 is increased, toner offset is reduced. Conversely, it means that it is necessary to increase the thickness of the fixation fluid layer on the surface of the application roller to some extent for uniform application which causes no offset of resin fine particles. On the other hand, a small amount of the fixation fluid on the resin fine particles on the medium after application is small is excellent in fixation responsibility or prevention of residual liquid feeling or curling, and this means that it is desirable that the weight of the fixation fluid is small. In order to satisfy the condition that the thickness and volume of the fixation fluid layer are large at the time of application and the weight of the fixation fluid on the medium is small after application, it is only necessary to lower the density of the fixation fluid, and then, the substantial weight for application may be reduced even if the volume is large at the time of application.

Figure 2:
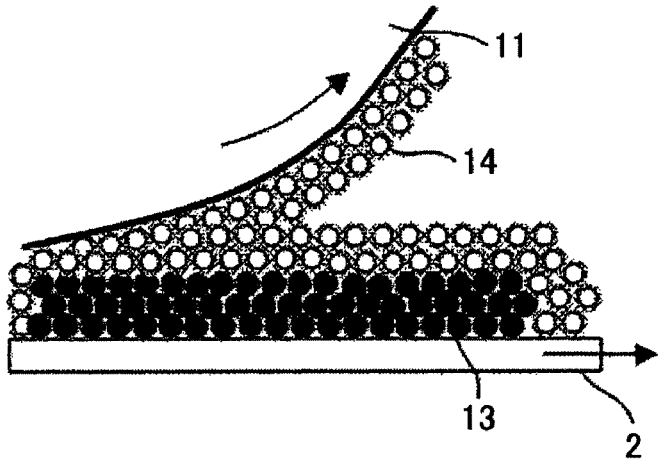
FIG. 2 is a conceptual diagram showing a situation of application of a fixation fluid in an embodiment of the present invention.

FIG. 2 is a conceptual diagram showing a situation of application of a fixation fluid according to an embodiment of the present invention. In the figure, the same reference numerals as those of FIG. 1 designate the same components as those of FIG. 1. As shown in the figure, the fixation fluid is foam-like and a foam-like fixation fluid 14 involving sufficient air is a fixation fluid with a low bulk density (a value of the weight of a fixation fluid divided by the volume thereof). As this fixation fluid is used, the bulk density is small. Therefore, even if the thickness and volume of a fixation liquid layer on the application roller 11 are larger at the time of application, the substantial weight of a fixation fluid adhering to a paper sheet may be reduced, and a slight amount of the fixation fluid may be applied on a recording medium such as a paper sheet without causing toner offset.

Figure 3A:
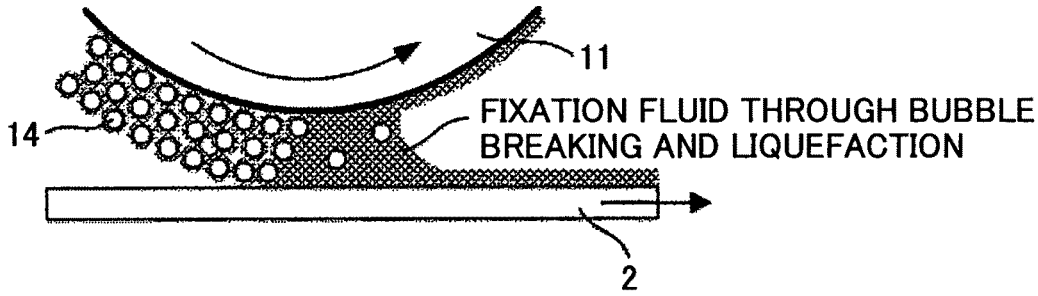
FIGS. 3A and 3B are conceptual diagrams showing situations of application of a foam-like fixation fluid.
Figure 3B:
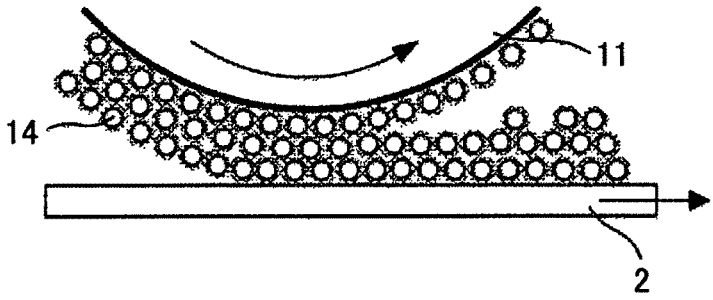

However, as shown in FIG. 3A, if a foam-like fixation fluid 14 formed on an application roller is subjected to bubble breaking due to contact with a recording medium 2 such as a paper sheet and the fixation fluid is liquefied on the roller, the effect of foam is lost. That is, as shown in FIG. 3B, a foam-like fixation fluid 14 is desired which is excellent in foaming stability at a contact area between the application roller 11 and the recording medium 2 such as a paper sheet.

Herein, when a fixation fluid contains a salt of aliphatic acid as a foaming agent and water according to an embodiment of the present invention, which salt of aliphatic acid is known as a surfactant, a fixation fluid is provided which withstands bubble breaking well so that no bubble breaking or liquefaction is caused at a contact area between the application roller 11 and the recording medium 2 such as a paper sheet.

Figure 4A:
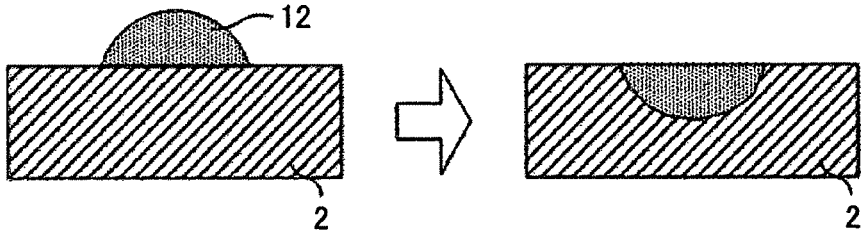
FIGS. 4A, 4B and 4C are schematic cross-section diagrams showing situations of permeation of a used fixation fluid into a recording medium such as a paper sheet which fluid contains water and a salt of aliphatic acid as a foaming agent.
Figure 4B:
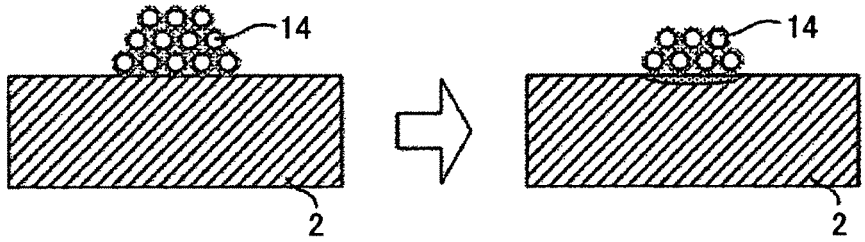
Figure 4C:
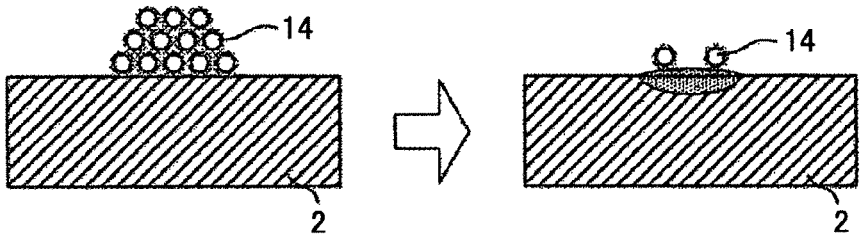

Furthermore, FIG. 4 is a schematic diagram showing a situation of permeation of a used fixation fluid into a recording medium such as a paper sheet which fixation fluid contains water and a salt of aliphatic acid as a foaming agent. As shown in FIG. 4A, a liquid fixation fluid 12 permeates into a recording medium 2 such as a paper sheet quickly. Surprisingly, it has been found that once a foam-like one is provided, such a foam-like fixation fluid 14 is extremely not easy to permeate into a recording medium 2 such as a paper sheet, as shown in FIG. 4B. If the permeability of a fixation fluid into a recording medium such as a paper sheet is high, the amount of an applied fixation fluid is increased. However, it has been found that a foam-like fixation fluid which contains water and a salt of aliphatic acid as a foaming agent has a small permeability into a paper sheet, as shown in FIG. 4B, and is extremely effective to reduction of the amount of an applied fixation fluid. Also, it has been found that when another surfactant such as a polyoxyethylene-type surfactant and sodium laurylsulfate is used instead of a salt of aliphatic acid as a foaming agent, a foam-like fixation fluid is frequently subjected to bubble breaking at a contact area with a recording medium 2 such as a paper sheet and the fixation fluid quickly permeates into the recording medium 2 such as a paper sheet, as shown in FIG. 4C. From these results, it has been found that a fixation fluid containing a surfactant has a low surface tension of the fluid and the fluid on the condition of liquid is east to permeate into a recording medium 2 such as a paper sheet but, once such a liquid is foamed, bubbles contribute to hold the liquid (mainly, water) on a foam wall (a plateau border) and to inhibit permeation of liquid into a recording medium 2 such as a paper sheet. Furthermore, it has been found that, when a salt of aliphatic acid is used as a foaming agent, the foaming stability of the foaming agent is extremely high such that bubble breaking is not easily caused even if a foam-like fixation fluid contacts a recording medium such as a paper sheet, and hence, permeation of a foam-like fixation fluid into a paper sheet may be suppressed significantly.

Meanwhile, the applicant disclosed a technique for applying a foam-like fixation fluid onto an intermediate transcriptional belt in Japanese Patent Application Publication No. 2004-109747 by focusing attention on the fact that a bulk density is decreased by such foaming, and suggested application of a slight amount of the foam-like fixation fluid. However, the technique disclosed in Japanese Patent Application Publication No. 2004-109747 does not aim to prevent offset or image deletion but mainly aims to reduce the amount of a fixation fluid. Also, Japanese Patent Application Publication No. 2004-109747 does not disclose a configuration of direct application fixation with a contact application part, such as roller application to unfixed toner on a recording medium such as a paper sheet, or layer thickness control but merely discloses a configuration for providing a traveling foam-like fixation liquid onto unfixed toner on an intermediate transcriptional body. Also, in contact application such as roller application, a foam-like fixation fluid containing fine air bubbles may be uniformly provided onto an unfixed toner image so as to provide a thin layer and application irregularity is not easy to occur. Furthermore, roller application was examined with a foam-like fixation fluid obtained by containing air bubbles in a fixation liquid, and it has been found that only simple application of a foam-like fixation fluid does not necessarily have an effect of preventing offset of resin fine particles onto a roller surface in roller application. Then, it has been found that control of the layer thickness of a fixation fluid layer including an air bubble layer and the configuration of the air bubble layer in a foam-like fixation fluid on the surface of an application roller in a roller application part are important for prevention of the offset.

Also, as described above, when a salt of aliphatic acid is used as a foaming agent, the foaming stability becomes higher and a foam-like fixation fluid becomes not easy to permeate into a recording medium such as a paper sheet. This is advantageous but a foam-like fixation fluid might also become not easy to permeate into a toner layer. When a fixation fluid does not permeate into a toner layer, sticking among toners due to the fixation liquid does not occur and defective fixation may be caused. Herein, it has been found that the thickness of a foam-like fixation fluid layer on an application roller and a pressure at a contact area between the application roller and a recording medium such as a paper sheet influence the permeability of the foam-like fixation fluid into a toner layer and further influence toner offset onto the application roller.

Figure 5A:
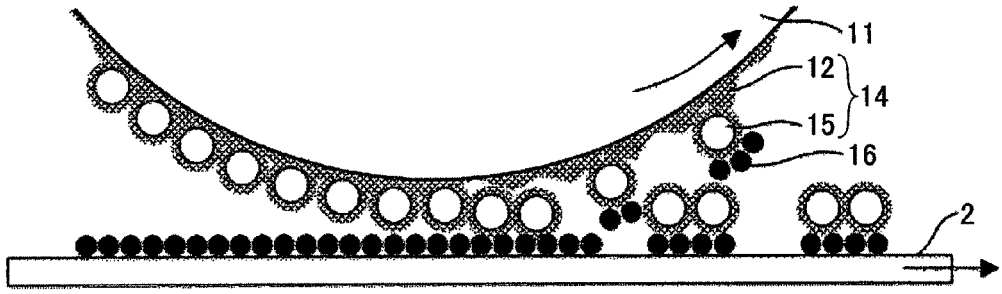
FIGS. 5A and 5B are enlarged views of a part at which the application surface of an application roller contacts unfixed resin fine particles, when a low pressure is applied on the contact area between the roller and a recording medium.
Figure 5B:
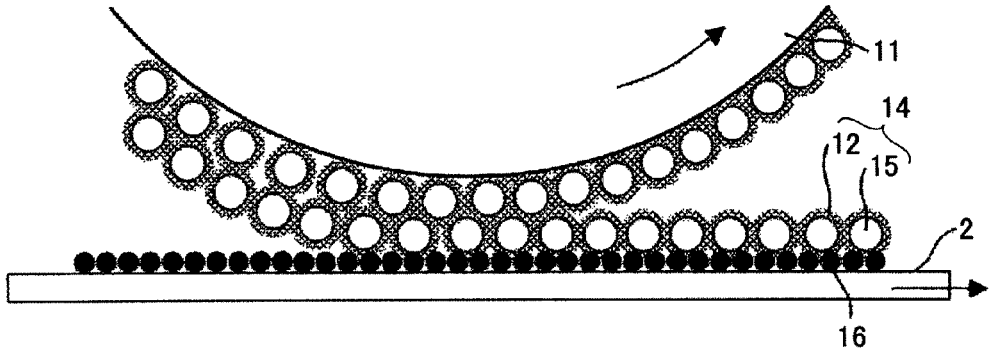
Figure 6A:
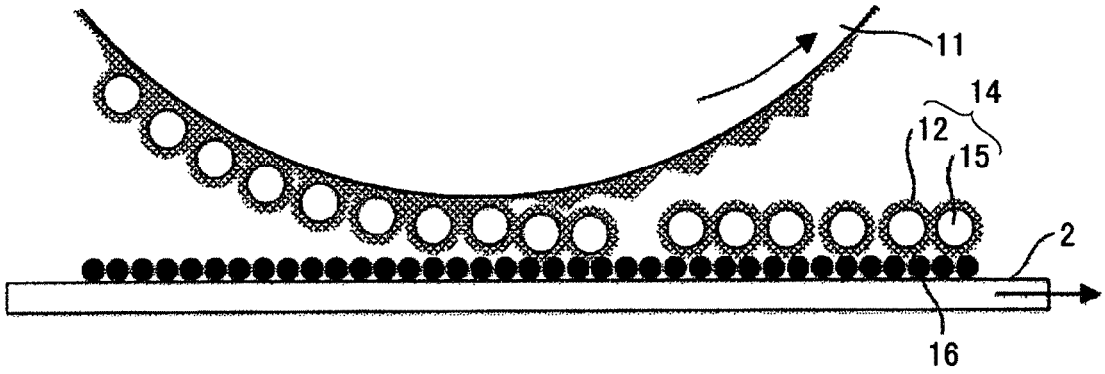
FIGS. 6A and 6B are enlarged views of a part at which the application surface of an application roller contacts unfixed resin fine particles, when a high pressure is applied on the contact area between the roller and a recording medium.
Figure 6B:
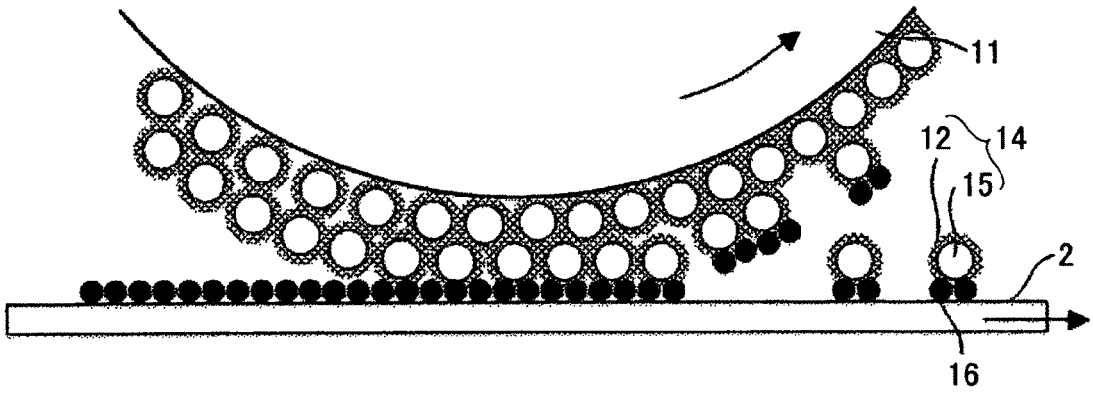

FIGS. 5A and 5B and FIGS. 6A and 6B are enlarged views of an area at which the roller application surface of a roller application part and unfixed resin fine particles. In these figures, the same numeral references as those of FIG. 1 and FIG. 2 designate the same components as those of FIG. 1 and FIG. 2. Additionally, FIGS. 5A and 5B show the case of a lower applied pressure at a contact area between an application roller 11 and a recording medium and FIGS. 6A and 6B show the case of a higher applied pressure. Also, the diameters of air bubbles shown in FIGS. 5A and 5B and FIGS. 6A and 6B are approximately identical and air bubbles 15 shown in these figures are primary air bubbles, wherein other air bubbles are present but are omitted in these figures. FIG. 5A shows an example of a foam-like fixation fluid 14 with a single layer of air bubbles 15 at an application surface of an application roller 11 and FIG. 5B shows an example of a bilayer-type air bubble layer. Therefore, the layer thickness of the foam-like fixation fluid in FIG. 5A is less than that of FIG. 5B. As shown in FIG. 5A, when the air bubbles 15 constitutes a single layer and an applied pressure is small, the air bubbles, themselves, are easy to adhere to the application surface of the application roller 11 due to the surface tension and a fixation fluid 12 may be applied onto a layer of resin fine particles ununiformly, whereby a part of the resin fine particles are adsorbed onto the air bubbles 15 and offset onto the application surface of the application roller 11. On the other hand, as shown in FIG. 5B, when a foam-like fixation fluid 14 on the application surface of the application roller 11 has plural air bubble layer structures, it becomes possible for air bubbles 15 to be embedded into the surface of unfixed toner 16 which has irregularities and the foam-like fixation fluid 14 becomes easy to separate between the layers of air bubbles 15, whereby uniform application onto resin fine particles is allowed and offset of the resin fine particles may become very difficult to occur, as shown in FIG. 5B.

Therefore, for example, when the resin fine particles are toner particles and the medium is a recording medium such as a paper sheet and where a pressure applied on a contact area between the application roller and the recording medium is set to be low in order to preferentially reduce load on a driving system for recording medium conveyance, the average size of created air bubbles are preliminarily measured and the layer of air bubbles are controlled to be composed of plural layers, wherein the layer thickness of a foam-like fixation fluid layer on the application roller is the total thickness of plural air bubble layers, in order that unfixed toner does not offset onto the application roller. Thus, the foam-like fixation fluid layer is formed on the application roller which layer is necessarily composed of plural air bubble layers, so that it becomes possible to prevent the offset of toner.

On the other hand, where a pressure applied on a contact area between the application roller 11 and the recording medium is set to be high in order to provide a fixation fluid onto a not-necessarily smooth recording medium such as a woodfree paper sheet uniformly or without non-uniformity, a foam-like fixation fluid 14 on the application surface of an application roller 11 has a single layer structure of air bubbles 15 as shown in FIG. 6A, but air bubbles 15 are easily embedded in a irregular layer of resin fine particles due to a high applied pressure and an air bubble layer easily removed from the application surface of the application roller 11, whereby the foam-like fixation fluid 14 is uniformly applied on the resin fine particles. On the other hand, as shown in FIG. 6B, even if a foam-like fixation fluid 14 on the application surface of an application roller 11 has plural air bubble layer structures, when an applied pressure is high, air bubbles 15 are pressurized into a layer of resin fine particles. Since the air bubble layer is thick, diffusion of fine particles from a fine particle layer to the air bubble layer becomes easy to occur, so that the resin fine particle layer may be disturbed or a part of diffused fine particles adheres to the application roller 11, whereby offset may occur.

Thus, when a pressure applied on a contact area between an application roller and a recording medium, the average size of air bubbles is preliminarily measured and the thickness of a fixation fluid layer is controlled to provide a foam-like fixation fluid having an air bubble layer structure with a thin layer thickness on the application roller surface which layer is a single layer as nearly as possible. Accordingly, a fluid layer having an air bubble layer structure which is nearly a single layer is formed on the application roller and toner offset may be prevented on the condition of high pressure. Also, if the air bubble layer on the application roller is too thick, flow of the air bubble layer may occur at a contact area between the application roller and the recording medium and the resin fine particles move along with the flow, whereby a disadvantage of image deletion may be caused if the resin fine particles are toner. However, it may be solved by controlling the layer thickness of a foam-like fixation fluid layer in a range causing no flow.

Although it has been described above that the contact pressure between an application roller and a medium and the layer thickness of a foam-like fixation fluid on the application roller are main factors for toner offset onto the application roller or an image irregularity, the medium may be a board postcard paperboard or thin woody paper sheet or the thickness of a paper sheet varies depending on the kind of paper sheet, whereby the contact pressure between the application roller and the medium varies. Specifically, the contact pressure for a paperboard is higher and the contact pressure for a thin paper sheet is lower. Accordingly, it may be necessary to control the layer thickness of a foam-like fixation fluid on the application roller to be in an optimum range thereof depending on the kinds of those paper sheets. In addition, the thickness of a toner layer on the paper sheet varies depending on the kind of image such as monochrome, color, text, and photographic images. Specifically, when the toner layer is thicker, the contact pressure is higher and when the toner layer is thinner, the contact pressure is lower. Accordingly, it may be necessary to control the layer thickness of a foam-like fixation fluid on the application roller in an optimum range thereof depending on the thickness of the toner layer based on image information. In any event, good fixation is not necessarily conducted by simply using a foam-like fixation fluid, and it is substantially necessary to control the layer thickness of a foam-like fixation fluid by means of application depending on a contact pressure which is adjusted based on an application condition such as the kind of paper sheet and the thickness of a toner layer.

As described above, toner offset onto a contact application part such as an application roller or image deletion may be prevented by controlling the layer thickness oh a layer of foam-like fixation fluid which contains a softening agent, water and a salt of aliphatic acid as a foaming agent, whereby fixation with a slight amount application may be attained. That is, an embodiment of the present invention is a method for fixing resin fine particles on a medium by applying a fixation fluid onto the resin fine particles on the medium using a contact application part and a fixing agent obtained by containing into a fixation fluid a softening agent that dissolves or swells at least one portion of the resin fine particle so as to soften the resin fine particle and further containing water and a salt of aliphatic acid as a foaming agent into it. Herein, when the fixation fluid is provided on the surface of the resin fine particle on the medium, the fixation fluid is in a foam-like condition containing air bubbles in the application of the fixation fluid contacting the fine particles and further the layer thickness of the foam-like fixation fluid layer is controlled depending on a pressure applied thereto. Thereby, offset of the resin fine particles onto the contact application part such as an application roller or deletion of a resin film fine particle layer may be prevented so as to attain fixation with a slight amount application. Also, as resin fine particles, toner fine particles used for an electrophotographic technique are highly effective for an embodiment of the present invention, and toner offset or image deletion may be prevented by controlling the layer thickness of a foam-like fixation fluid layer depending on the thickness of a layer of the resin fine particles.

Figure 7:
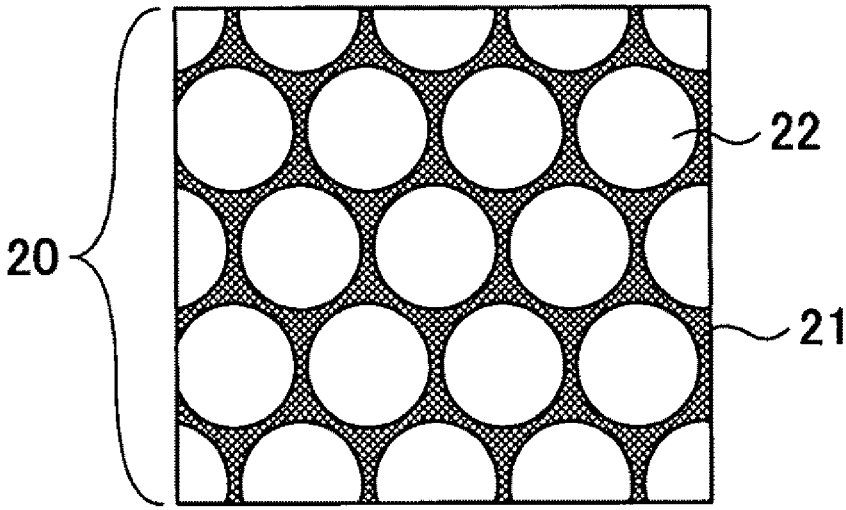
FIG. 7 is a schematic diagram showing an example of the layer configuration of a foam-like fixation fluid at the time of application in an embodiment of the present invention.
Figure 8:
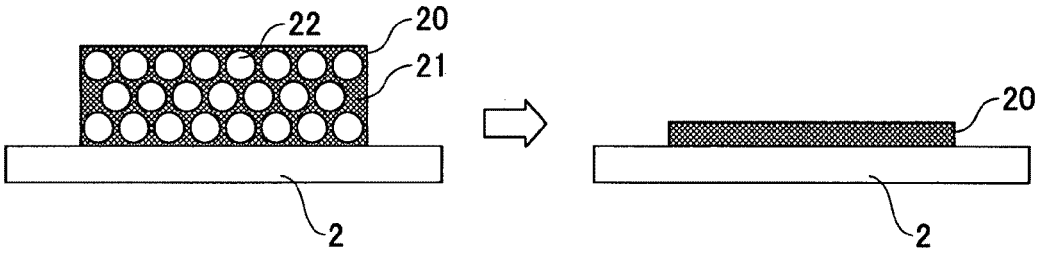
FIG. 8 is a diagram showing transformation of a fixation fluid after application of the fixation fluid.

FIG. 7 is a conceptual diagram showing an example of the structure of a layer of a foam-like fixation fluid at the time of application thereof in an embodiment of the present invention. A liquid 21 shown in the figure contains a softening agent, water and a salt of aliphatic acid as a foaming agent and has a foam-like structure such that air bubbles 22 are contained in a liquid. Thus, the bulk density of the fixation fluid 20 may be extremely reduced by containing a large amount of air bubbles 22. As such a configuration is adopted, the bulk density of a fixation fluid is low and the application weight thereof is small at the time of application thereof even if a large volume of it is applied. Therefore, as shown in FIG. 8, when air bubbles 22 are subsequently subjected to bubble breaking, the substantial application amount may be extremely reduced. Additionally, the term "foam-like" in an embodiment of the present invention means a condition such that a large amount of air bubbles are dispersed in a liquid and the liquid takes a compressive property.

Figure 9:
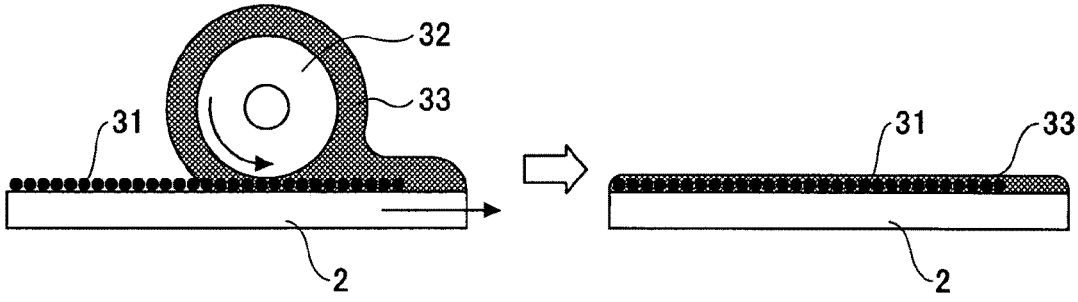
FIG. 9 is a schematic diagram showing a situation of applying a foam-like fixation fluid onto an application roller by a fixation fluid applying part in an embodiment of the present invention.

Next, a fixation fluid applying part in an embodiment of the present invention is described below. The fixation fluid applying part in an embodiment of the present invention is a contact application part. FIG. 9 is a conceptual diagram showing a situation of application of a foam-like fixation fluid by an application roller as a fixation fluid applying part in an embodiment of the present invention. In the figure, resin fine particles 31 are toner particles. A layer of a foam-like fixation fluid 33 is formed on an application roller 32, which has a layer thickness of the fixation fluid layer which is optimized depending on the size of an air bubble in the foam-like fixation fluid 33, an applied pressure and the thickness of unfixed toner layer, and the resin fine particles 31 are not offset onto the application roller 32. If the foam-like fixation fluid 33 is thickly applied on a layer of the resin fine particles 31 and a recording medium 2, the bulk density of the foam-like fixation fluid 33 is extremely low, and therefore, the contained air bubbles are subjected to bubble breaking after a predetermined time period of foaming, whereby a slight amount of a liquid containing a softening agent may be applied to a layer of the resin fine particles 31.

Additionally, although the content of air bubbles in a foam-like fixation fluid varies depending on the bulk density and applied layer thickness thereof, it is commonly desirable the bulk density is in a range of about 0.01 $g/cm^3$-about 0.1 $g/cm^3$. Also, a foam-like fixation fluid including an air bubble layer means a foam-like fixation fluid including a single or plural air bubble layers, in which a distinct layer face is not necessarily required. Furthermore, it is only necessary for a fixation fluid to be foam-like at the time of application onto a layer of resin fine particles such as toner particles on a recording medium such as a paper sheet and it is not necessary to be foam-like in a stock container. It is desirable to provide a device for making a liquid containing no air bubble in a stock container be foam-like at the time of supplying the liquid from the container or in a route for conveying the liquid before it is applied onto a layer of resin fine particles. This is because the configuration of liquid in a stock container and foam-like after taking the liquid from the container has a great advantage such that the contained may be miniaturized.

Herein, a method for providing a foam-like fixation fluid is described below which contains air bubbles after taking a liquid-type fixation fluid from a closed container.

Figure 10A:
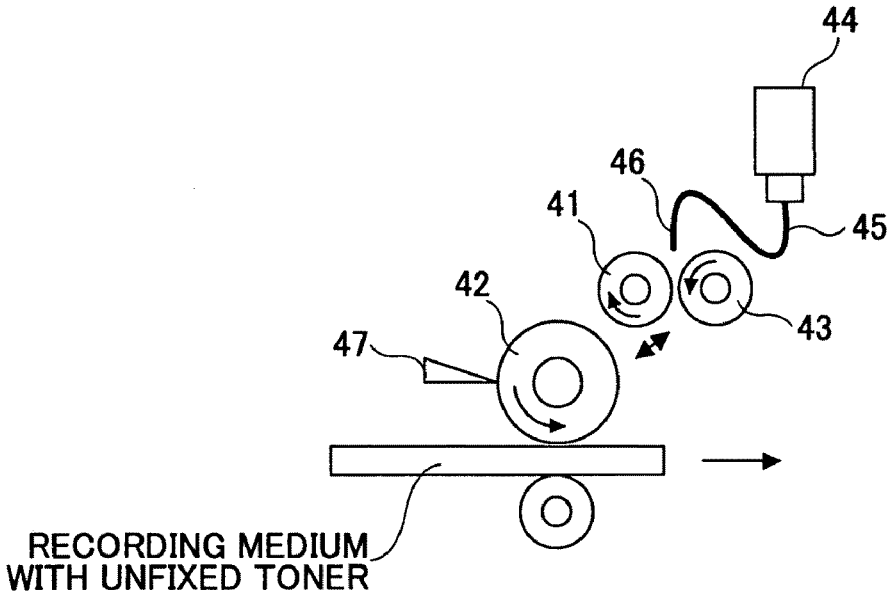
FIGS. 10A and 10B are schematic diagrams showing examples of a foam-like fixation fluid producing part and a foam-like fixation fluid layer thickness controlling part in an embodiment of the present invention.
Figure 10B:
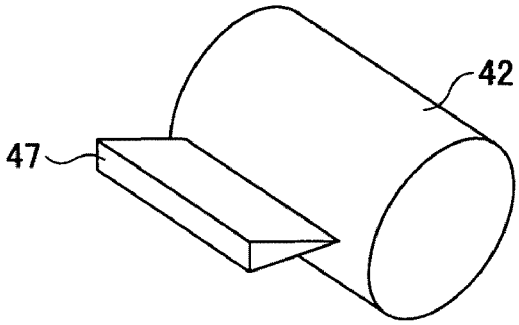

The first method is a method such that a liquid-type fixation fluid containing a softening agent in a closed container is taken from the container and subsequently a large amount of air bubbles are contained by an air bubble producing device which applies a shearing force to the liquid-type fixation fluid so as to produce air bubbles. The air bubbles are produced due to the cavitation in the fluid or involvement of air when the shearing force is applied. FIGS. 10A and 10B show a specific example in which an agitating roller is used as a device for applying a shearing force. In FIG. 10A, a liquid-type fixation fluid supplied from a fixation fluid closing container 44 for storing the fixation fluid and passing through a fluid conveyance pipe 45 and a fluid supply port 46 is received at a nip area between a foam-like fixation fluid supplying roller 41 and an agitation roller 43 on the condition that the fixation fluid supplying roller 41 is once separated from an application roller 42. Then, a foam-like fixation fluid is formed by rotary agitation of the agitation roller 43, and subsequently, the fixation fluid supplying roller 41 contacts the application roller 42 so as to supply the foam-like fixation fluid onto the application roller 42. Furthermore, as shown in FIGS. 10A and 10B, the layer thickness of a fixation fluid layer on the roller surface of the application roller 42, which thickness has been optimized based on the sizes of air bubbles in a foam-like fixation fluid and an applied pressure, is then controlled by a fluid layer thickness controlling blade 47.

Additionally, the surface of the agitation roller 43 in FIG. 10A may be flat but it is desirable that a groove or anilox may be formed so as to agitate the fluid better. Also, the fluid layer thickness controlling blade 47 may be either counter-directional or tailing-directional. Furthermore, there may be provided a spacer for controlling a gap between the application roller 42 and the fluid layer thickness controlling blade 47.

Figure 11:
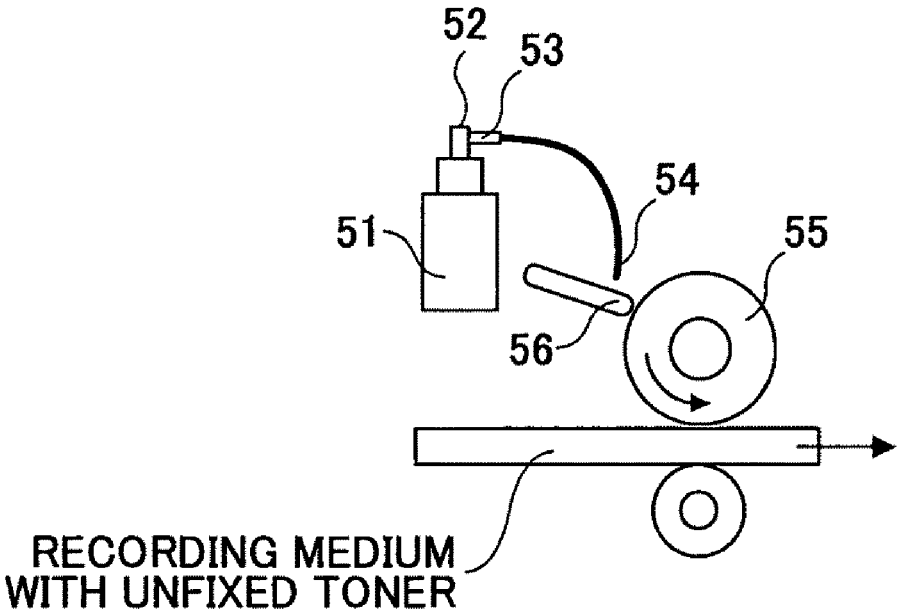
FIG. 11 is a schematic diagram showing other examples of a foam-like fixation fluid producing part and a foam-like fixation fluid layer thickness controlling part in an embodiment of the present invention.

The second method, as shown in FIG. 11, is such that a foam-like fixation fluid is produced by dispersing an atmospheric component or an alkane which is in gas phase under atmospheric pressure in a fixation fluid which is a liquid-type fixation fluid containing a softening agent, putting it in a closed container 51 which is closed under atmospheric or higher pressure, and containing a large amount of air bubbles in the fluid due to expansion of gas ejected from a nozzle 53 through actuator 52 attached to the closed container 51, and the foam-like fixation fluid passing through a fluid conveyance pipe and ejected from a fluid supply port 54 is supplied to a nip area between an application roller 55 and a blade 56 contacting it. The gap between the blade 56 and the application roller 55 is adjusted and the layer thickness of the foam-like fixation fluid layer on the application roller 55 is controlled, so that the layer thickness of the fixation fluid layer which has been optimized baser on the sizes of air bubbles in the foam-like fixation fluid and the applied pressure is further controlled.

Figure 12A:
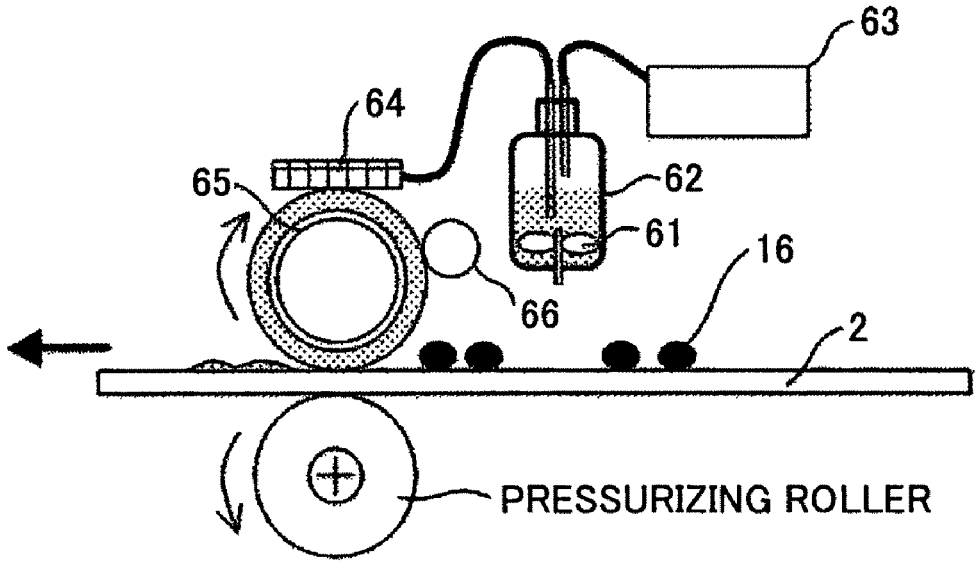
FIGS. 12A and 12B are schematic diagrams showing other examples of a foam-like fixation fluid producing part and a foam-like fixation fluid layer thickness controlling part in an embodiment of the present invention.
Figure 12B:
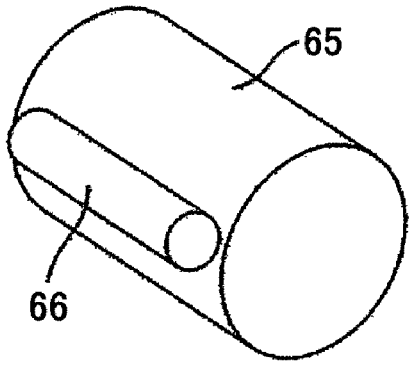

The third method, as shown in FIGS. 12A and 12B, is such that a foam-like fixation fluid is formed by agitating a liquid-type fixation fluid containing a softening agent, water and a salt of aliphatic acid as a foaming agent in a closed container 62 using an agitation wing 61 as a device for applying a shearing force and the foam-like fixation fluid is supplied onto the application surface of an application roller 65 by a fixation fluid supply pad 64 while the foam-like fixation fluid is ejected from the closed container 62 by using a high pressure gas from a pressure bomb 63. Then, as shown in FIGS. 12A and 12B, the thickness of the foam-like fixation fluid on the application roller 65 is controlled by a wire bar 66, so that the layer thickness of the fixation fluid layer is controlled which has been optimized based on the sizes of air bubbles on the foam-like fixation fluid and the applied pressure. Additionally, even if air bubbles are lost and there is liquid in the closed container during long term storage, a foam-like fixation fluid is provided by agitation just before the use thereof.

Figure 13:
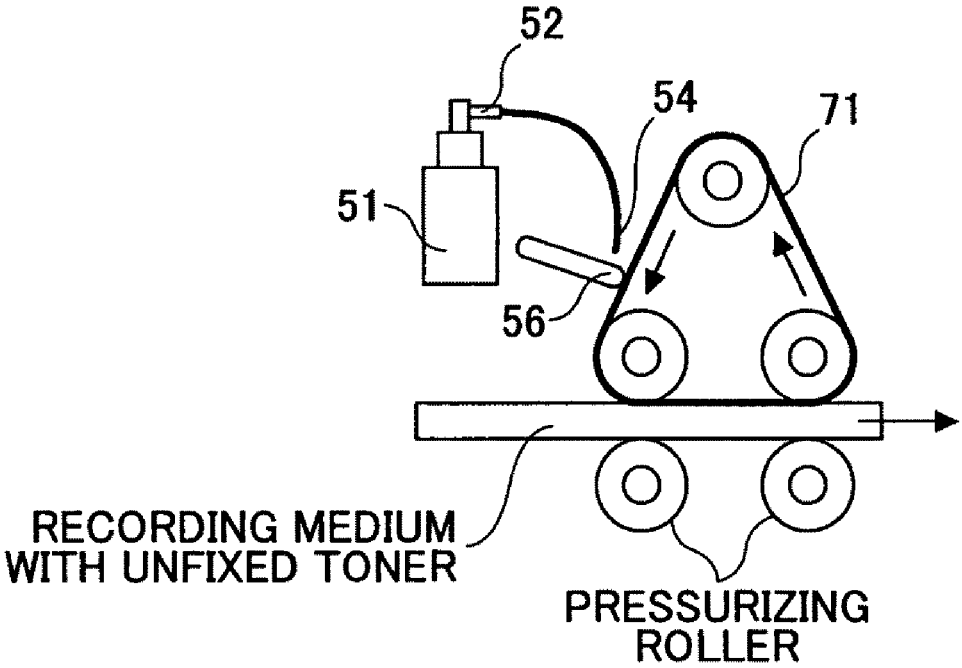
FIG. 13 is a schematic diagram showing other examples of a foam-like fixation fluid producing part and a foam-like fixation fluid layer thickness controlling part in an embodiment of the present invention.

Also, the fourth method, as shown in FIG. 13, is a method of application onto unfixed toner on a recording medium which uses an application belt 71 instead of an application roller as shown in FIG. 11. A foam-like fixation fluid is produced by containing a large amount of air bubbles in the fluid due to expansion of gas which is in gas phase under atmospheric pressure or an atmospheric component when ejecting from a nozzle 53 through actuator 52 attached to a closed container 51, and the foam-like fixation fluid passing through a fluid conveyance pipe and ejected from a fluid supply port 54 is supplied to a nip area between an application belt 71 and a blade 56 contacting it. Then, the gap between the blade 56 and the application belt 71 is adjusted and the layer thickness of the foam-like fixation fluid layer on the application belt 71 is controlled, so that the layer thickness of the fixation fluid layer which has been optimized baser on the sizes of air bubbles in the foam-like fixation fluid and the applied pressure is further controlled. Additionally, as an application belt 71, for example, a member obtained by coating a releasing fluororesin such as PFA onto a substrate such as a seamless nickel belt and a seamless PET file is used.

Figure 14A:
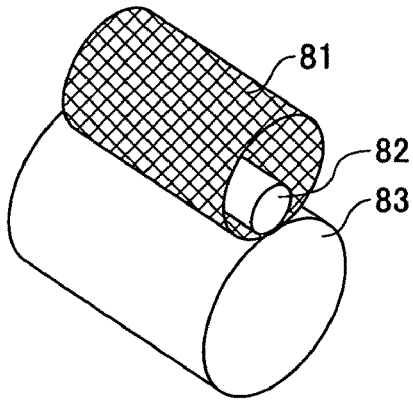
FIGS. 14A and 14B are schematic diagrams showing other examples of a foam-like fixation fluid producing part and a foam-like fixation fluid layer thickness controlling part in an embodiment of the present invention.
Figure 14B:
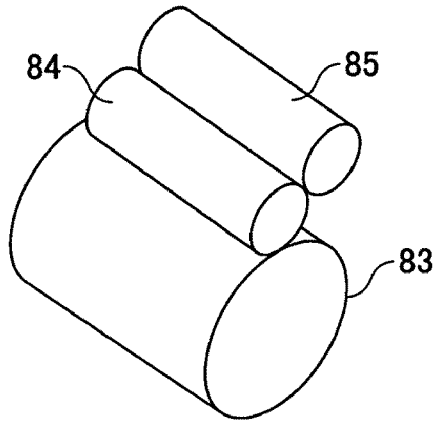

Next, a method or part for controlling the thickness of a foam-like fixation fluid at the surface of a contact member is described below. The optimum layer thickness which should be controlled is determined by the average particle diameter of air bubbles formed by a foam-like fixation fluid producing part, an applied pressure at a contact area between an application part and a medium, and the fluid viscosity. As a method for controlling the fluid layer to within a determined suitable range, a method for scraping a foam-like fixation fluid while a gap with the application part is provided is suitable among application devices using a roller-shaped rotary member. For example, scraping by the fluid layer thickness controlling blade 47 described above with reference to FIG. 11 or scraping by the wire bar 66 described above with reference to FIGS. 12A and 12B is desirable. In the configuration of scraping by the fluid layer thickness controlling blade 47 shown in FIG. 11, the roller surface of the application roller 42 and the fluid layer thickness controlling blade 47 are arranged with a gap which is generally in a suitable range of layer thickness. In the configuration of scraping by the wire bar 66 shown in FIGS. 12A and 12B, the wire diameter is determined in a suitable range of layer thickness. Also, as another method or part for controlling the thickness, there is provided a method for supplying a foam-like fixation fluid such that a suitable thickness of layer is provided on the application surface by a roller-shaped rotary member. In FIG. 14A, a foam-like fixation fluid is retained inside a tubular stencil member 81 and the foam-like fixation fluid is supplied onto the surface of an application member 83 while it is pushed out by a press roller 82. At this time, the mesh opening diameter of the tubular stencil member 81 is determined to form a suitable fluid layer. Also, FIG. 14B shows an example of supply by a groove roller 84, wherein the groove depth of the groove roller 84 is determined to form a suitable fluid layer. Additionally, the contact application device for a foam-like fixation fluid may be, for example, a device for direct stencil application, gravure roller application, or rotary wire bar application other than a roller application device. Any of these devices is a device with a surface having a mesh-like, stripe-like or irregular shape and the fluid layer of a foam-like fixation fluid at a contact area between an application surface and a medium may be controlled by controlling the application amount.

Next, the fluid formulation of a fixation fluid is described below. As described above, the foam-like fixation fluid has a configuration such that air bubbles are contained in a liquid containing a softening agent. The liquid containing a softening agent contains air bubbles stably and it is desirable to have a foaming agent and a bubble increasing agent in order to provide a foam-like one having air bubble layer which includes air bubbles having as a uniform size as possible. Also, when the viscosity is high to some extent, air bubbles are stably dispersed in liquid, and therefore, it is desirable to contain a thickening agent.

Also, as a foaming agent, salts of aliphatic acids are desirable. Since the salts of aliphatic acids provide surface activity, the surface tension of a fixation fluid containing water is reduced so that the fixation fluid is easily foamed. Also, since the salt of aliphatic acid has a layered or lamellar structure on the surface of a bubble, a foam wall (plateau border) thereof is more robust than those of other surfactants and foaming stability is extremely high. Furthermore, it is desirable to contain water in the fixation fluid in order to make the foamability of a salt of aliphatic acid be effective. As an aliphatic acid, saturated aliphatic acids are desirable which is resistant to oxidation, from the viewpoint of long-term stability in atmosphere. However, when a slight amount of a salt of unsaturated aliphatic acid is contained in a fixation fluid containing a salt of saturated aliphatic acid, the solubility or dispersibility of the salt of aliphatic acid is improved to have excellent foamability at a low temperature of 5° C. through 15° C., whereby stable fixation may be attained in a wide range of environmental temperature and the separation of a salt of aliphatic acid in a fixation fluid may be prevented when the fixation fluid is left within a long time period.

Moreover, as an aliphatic acid used for a salt of saturated aliphatic acid, saturated aliphatic acids whose carbon number is 12, 14, 16, or 18, more specifically, lauric acid, myristic acid, palmitic acid, and stearic acid, are suitable. Salts of saturated aliphatic acids whose carbon number is equal to or less than 11 have relatively stronger odor, and therefore, are not suitable for an image forming instrument which uses the fixation fluid and is used in an office or home. On the other hand, salts of saturated aliphatic acids whose carbon number is equal to or greater than 19 have relatively lower solubility in water and significantly degrade the leaving stability of a fixation fluid. Salts of saturated aliphatic acids which may be derived from these saturated aliphatic acids are used as a foaming agent singularly or in combination.

Also, as an aliphatic acid used for a salt of unsaturated aliphatic acid, unsaturated aliphatic acids whose carbon number is 18 and double-bond number is 1 through 3 are desirable. Specifically, oleic acid, linoleic acid, and linolenic acid are suitable. If the double-bond number is equal to or greater than 4, the reactivity is relatively high, and therefore, the leaving stability of a fixation fluid is degraded. Salts of unsaturated aliphatic acids which may be derived from these unsaturated aliphatic acids are used as a foaming agent singularly or in combination. Also, the salt of saturated aliphatic acid and the salt of unsaturated aliphatic acid may be mixed and used as a foaming agent.

Furthermore, when the salt of saturated aliphatic acid or the salt of unsaturated aliphatic acid is used as a foaming agent for the fixation fluid, sodium salts, potassium salts and amine salts are desirable. After a fixation device is powered on, it is important to quickly provide a condition capable of fixing, in view of the commercial value of a fixation device. In order to provide a condition capable of fixing in a fixation device, it is necessary for a fixation fluid to be suitable foam-like one. Since the above-mentioned salts of aliphatic acids may be foamed quickly, a condition capable of fixing may be provided within a short time period after the power-on of the fixation device. Particularly, if an amine salt is used, the fixation fluid is foamed within relatively shorter time period when a shearing force is applied to the fixation fluid, so that a foam-like fixation fluid may be easily produced and a condition capable of fixing may be provided within a relatively shorter time period after a fixation device is powered on.

Moreover, it is desirable that the thickness of a foam-like fixation fluid layer at application area is greater than the thickness of a resin fine particle layer in order to prevent the offset. Also, it is desirable for an air bubble to be larger than a resin fine particle in order to easily adhere to the resin fine particle. When the resin fine particle is a toner particle, the size of the toner particle is about 4 μm-about 10 μm in a dry electrophotographic process. Since the thickness of an unfixed toner layer on a paper medium is about 10 μm-30 μm, it is desirable that the size of an air bubble contained in a liquid containing a softening agent is about 5 μm-about 30 μm.

Also, it is desirable that a dilution solvent is aqueous. The dilution configuration may be a configuration such that a softening agent is dissolved in a dissolution solvent, a configuration of O/W emulsion such that a softening agent is oily and a dilution solvent is aqueous, or a configuration of W/O emulsion such that a softening agent is oily and a dilution solvent is aqueous. Particularly, the configuration such that a softening agent is dissolved in a dilution solvent is desirable since it is excellent in the stability thereof during long-term storage.

Furthermore, a configuration such that a gas which is in a gas phase under atmospheric pressure or an atmospheric component is dissolved or dispersed in a liquid containing a softening agent is desirable in a configuration of storing a fixation fluid in a high-pressure closed container. As a gas which is in a gas phase under atmospheric pressure, aliuphatic hydrocarbons, for example, propane, butane, pentane, hexane, and dimethyl ether are suitable. As an atmospheric gas component, for example, nitrogen gas and argon gas are suitable. In such a configuration, a device for supplying a foam-like fixation fluid to an application member is not simplified or required since a high pressure gas is used, and a fixation device may be easily miniaturized since a device for mechanically applying a shearing force to a fixation fluid or a device for supplying a foam-like fixation fluid to an application member may be simplified.

Also, a softening agent in which softening is conducted by dissolving or swelling a resin includes an aliphatic ester. The aliphatic ester is excellent in a dissolving property or swelling property for dissolving or swelling at least one portion of a resin contained in, for example, toner.

Furthermore, it is preferable that the acute oral toxicity LD50 of a softening agent is greater than 3 g/kg, more preferably, is 5 g/kg, from the viewpoint of the safety thereof for a human body. The safety of aliphatic esters for a human body is high so that they are frequently used as cosmetic materials.

Also, since toner fixation on a recording medium is conducted in an instrument which is frequently used in a closed environment and a softening agent remains in toner after fixation of the toner on a recording medium, it is preferable that fixation of toner on a recording medium involves no generation of a volatile organic compound (VOC) or unpleasant odor. That is, it is preferable that a softening agent includes no volatile organic compound or a material causing unpleasant odor. Aliphatic esters have high boiling points and low volatilities and no irritating odor, compared with commonly used organic solvents (for example, toluene, xylene, methyl ethyl ketone, ethyl acetate).

Additionally, as a practical measure for odor measurement which may measure odor with a high precision in, for example, an office environment, an odor intensity index (10× log (dilution strength of a substance at which the odor of the substance is not sensed)) based on a triangle odor bag method that is a sensory measurement may be used as an index of odor intensity. Also, it is preferable that the odor intensity index of an aliphatic ester contained in a softening agent is equal to or less than 10. In this case, unpleasant odor is not sensed in a usual office environment. Furthermore, it is preferable that another fluid material contained in the fixation fluid, as well as the softening agent, also has no unpleasant odor or no irritating odor.

In the fixation fluid according to an embodiment of the present invention, the aliphatic ester preferably includes a saturated aliphatic ester. When the aliphatic ester includes a saturated aliphatic ester, the preservation stability of a softening agent (the resistance thereof to, for example, oxidation or hydrolysis) may be improved. Also, the safety of saturated aliphatic esters for a human body is high and many of saturated aliphatic esters may dissolve or swell a resin contained in toner within one second. Furthermore, saturated aliphatic esters may reduce the stickiness of a toner provided on a recording medium. It is considered that this is because a saturated aliphatic ester forms an oily membrane on the surface of dissolved or swelled toner.

Therefore, in a fixation fluid according to an embodiment of the present invention, the saturated aliphatic ester preferably includes a compound represented by a general formula of $$R_1COOR_2,$$

wherein $R_1$ is an alkyl group whose carbon number is equal to or greater than 11 and equal to or less than 14 and $R_2$ is a linear or branched alkyl group whose carbon number is equal to or greater than 1 and equal to or less than 6.

When the saturated aliphatic ester includes a compound represented by a general formula of $R_1COOR_2$, wherein $R_1$ is an alkyl group whose carbon number is equal to or greater than 11 and equal to or less than 14 and $R_2$ is a linear or branched alkyl group whose carbon number is equal to or greater than 1 and equal to or less than 6, the dissolving property or swelling property thereof for a resin contained in toner may be improved. Also, the odor intensity index of the compound described above is equal to or less than 10 and the compound described above has no unpleasant odor and no irritating odor.

As an aliphatic monocarboxylate ester which is the compound described above, for example, ethyl laurate, hexyl laurate, ethyl tridecylate, isopropyl tridecylate, ethyl myristate, and isopropyl myristate may be provided. Many of these aliphatic monocarboxylate esters which are the compounds described above are soluble in an oily solvent but are insoluble in water. Therefore, in regard to many of the aliphatic monocarboxylate esters which are the compounds described above, a fixation fluid with a configuration of dissolution or micro-emulsion is provided by containing a glycol as a dissolution auxiliary in an aqueous solvent.

Also, in a fixation fluid according to an embodiment of the present invention, the aliphatic ester preferably includes an aliphatic dicarboxylate ester. When the aliphatic ester includes an aliphatic dicarboxylate ester, a resin contained in toner may be dissolved or swelled for a shorter time period. For example, it is desirable that a time period for which a fixation fluid is provided onto unfixed toner on a recording medium and the toner fixes on the recording medium is within 1 second in high speed character printing of approximately 60 ppm. When the aliphatic ester includes an aliphatic dicarboxylate ester, a time period required for providing a fixation fluid to, for example, unfixed toner on a recording medium and fixing the toner on the recording medium may be within 0.1 second. Furthermore, since a resin contained in toner may be dissolved or swelled by addition of a smaller amount of a softening agent, the content of a softening agent contained in a fixation fluid may be reduced.

Therefore, in a fixation fluid according to an embodiment of the present invention, the aliphatic dicarboxylate ester preferably includes a compound represented by a general formula of $$R_3(COOR_4)_2,$$

wherein $R_3$ is an alkylene group whose carbon number is equal to or greater than 3 and equal to or less than 8 and $R_4$ is a linear or branched alkyl group whose carbon number is equal to or greater than 3 and equal to or less than 5.

When the aliphatic dicarboxylate ester includes a compound represented by a general formula of $R_3(COOR_4)_2$, wherein $R_3$ is an alkylene group whose carbon number is equal to or greater than 3 and equal to or less than 8 and $R_4$ is a linear or branched alkyl group whose carbon number is equal to or greater than 3 and equal to or less than 5, the dissolving property or swelling property thereof for a resin contained in toner may be improved. Also, the odor intensity index of the compound described above is equal to or less than 10 and the compound described above has no unpleasant odor and no irritating odor.

As an aliphatic dicarboxylate ester which is the compound described above, for example, 2-ethylhexyl succinate, dibutyl adipate, diisobutyl adipate, diisopropyl adipate, diisodecyl adipate, diethyl sebacate, and dibutyl sebacate may be provided. Many of these aliphatic dicarboxylate esters which are the compounds described above are soluble in an oily solvent but are insoluble in water. Therefore, a fixation fluid with a configuration of dissolution or micro-emulsion is provided by containing a glycol as a dissolution auxiliary in an aqueous solvent.

Furthermore, in a fixation fluid according to an embodiment of the present invention, the aliphatic ester preferably includes a dialkoxyalkyl aliphatic dicarboxylate. When the aliphatic ester includes a dialkoxyalkyl aliphatic dicarboxylate, the fixation property of toner on a recording medium may be improved.

In a fixation fluid according to an embodiment of the present invention, the dialkoxyalkyl aliphatic dicarboxylate preferably includes a compound represented by a general formula of $$R_5(COOR_6—O—R_7)_2,$$

wherein $R_5$ is an alkylene group whose carbon number is equal to or greater than 2 and equal to or less than 8, $R_6$ is an alkylene group whose carbon number is equal to or greater than 2 and equal to or less than 4, and $R_7$ is an alkyl group whose carbon number is equal to or greater than 1 and equal to or less than 4.

When the dialkoxyalkyl aliphatic dicarboxylate includes a compound represented by a general formula of $R_5(COOR_6—O—R_7)_2$, wherein $R_5$ is an alkylene group whose carbon number is equal to or greater than 2 and equal to or less than 8, $R_6$ is an alkylene group whose carbon number is equal to or greater than 2 and equal to or less than 4, and $R_7$ is an alkyl group whose carbon number is equal to or greater than 1 and equal to or less than 4, the dissolving property or swelling property thereof for a resin contained in toner may be improved. Also, the odor intensity index of the compound described above is equal to or less than 10 and the compound described above has no unpleasant odor and no irritating odor.

As a dialkoxyalkyl aliphatic dicarboxylate which is the compound described above, for example, diethoxyethyl succinate, dibutoxyethyl succinate, diethoxyethyl adipate, dibutoxyethyl adipate, and diethoxyethyl sebacate may be provided. Many of these dialkoxyalkyl aliphatic dicarboxylates may be used in a fixation fluid with a configuration of dissolution or micro-emulsion which is provided by containing a glycol as a dissolution auxiliary in an aqueous solvent.

Additionally, the fine particle containing a resin which is an object to be fixed is not limited to a toner particle and is any of particles containing a resin. For example, it may be a resin fine particle containing an electrically conductive material. Also, the recording medium is not limited to a recording paper sheet and may be, for example, any of metallic, resinous, and ceramic ones. However, the recording medium desirably has a permeability of a fixation fluid, and when the substrate of a medium has no fluid permeability, a medium having a fluid permeating layer on the substrate thereof is desirable. Also, the form of a recording medium is not limited to a sheet shape and may be a solid having a planar or curved surface.

Among the fine particles containing a resin, toner particles used in an electrophotographic process provide the most efficient fixation in combination with a fixation fluid according to an embodiment of the present invention. Toner contains a coloring agent, a charge controlling agent, and a resin such as a binder resin and a releasing agent. A resin contained in toner is not particularly limited. As a preferable resin, for example, polystyrene resins, styrene-acryl copolymer resins, and polyester resins are provided and as a releasing agent, for example, wax components such as carnauba wax and polyethylenes are provided. Toner may contain, for example, a publicly known coloring agent, charge controlling agent, flowability providing agent, or additive as well as a binder resin. Also, it is preferable that toner is water-repellent-treated by retaining a hydrophobic fine particle such as a hydrophobic silica or hydrophobic titanium oxide having a methyl group on the surface of the toner particle. Among the media, a recording medium is not particularly limited, and for example, a paper one, a cloth one, and a plastic film such as an OHP sheet having a liquid permeating layer are provided. The term "oily" in an embodiment of the present invention means a property such that solubility in water at room temperature (20° C.) is equal to or less than 0.1% by weight.

Also, it is desirable that a foam-like fixation fluid preferably has a sufficient affinity with a water-repellent-treated toner particle. Herein, the term "affinity" means the degree of the extension-wetting of a liquid on the surface of a solid when the liquid contacts the solid. That is, it is preferable that a foam-like fixation fluid exhibits a sufficient wetting property to a water-repellent-treated toner. The toner surface that is water-repellent-treated with hydrophobic fine particles such as hydrophobic silica particles and hydrophobic titanium oxide particles is covered with methyl groups present on the hydrophobic silica particles or the hydrophobic titanium oxide particles, and has a surface energy of about 20 mN/m. In fact, since the whole of the water-repellent-treated toner surface is not completely covered with hydrophobic fine particles, it is guessed the surface energy of the water-repellent-treated toner is about 20-30 mN/m. Therefore, it is preferable that the surface tension of a foam-like fixation fluid is 20-30 mN/m in order to have affinity (or a sufficient wetting property) with water-repellent toner.

When an aqueous solvent is used, it is preferable that a surfactant is added such that the surface tension is 20-30 mN/m. Also, in the case of an aqueous solvent, it is desirable to contain a mono- or poly-hydric alcohol. These materials have an advantage such that the stability of air bubbles in a foam-like fixation fluid is improved so as to be hardly subjected to bubble breaking. For example, monohydric alcohols such as cetanol and polyhydric alcohols such as glycerin, propylene glycol, and 1,3-butylene glycol are desirable. Also, inclusion of the monohydric or polyhydric alcohol provides an effect of prevention of curling of a recording medium such as a paper sheet.

Also, it is desirable to form an O/W emulsion or W/O emulsion by containing an oily component in a fixation fluid in order to improve the permeability thereof or prevent curling of a medium such as a paper sheet, and in this case, as a specific dispersing agent, desirable are sorbitan aliphatic esters such as sorbitan monooleate, sorbitan monostearate, and sorbitan sesquiolate and sucrose esters such as sucrose laurates and sucrose stearates.

Herein, as a device for dissolving or micro-emulsion-dispersing a softening agent in a fixation fluid, for example, a mechanically agitation device based on a rotary wing such as a homomixer and a homogenizer and a vibrating device such as an ultrasonic homogenizer are provided. In any of the cases, a softening agent is dissolved or micro-emulsion-dispersed by applying a strong shearing force to a fixation fluid.

Also, the toner fixation device may have a pair of smoothing rollers (hard rollers) for pressurizing a toner dissolved or swelled by an agent for dissolving or swelling at least one portion of a resin contained in the toner after a fixation fluid according to an embodiment of the present invention is supplied onto the toner. The dissolved or swelled toner is pressurized by the pair of smoothing rollers (hard rollers) so as to smooth the surface of a dissolved or swelled toner layer, so that the toner may be provided with glossiness. Furthermore, the fixation property of a dissolved or swelled toner on a recording medium may be improved by pushing the toner into the recording medium.

In an image forming apparatus according to one embodiment of the present invention, an image of a toner containing a resin is formed on a recording medium by using an image forming method as described above. Therefore, due to an image forming apparatus according to an embodiment of the present invention, each of an image forming method and image forming apparatus which are capable of fixing toner on a recording medium more efficiently may be provided as described above.

Figure 15A:
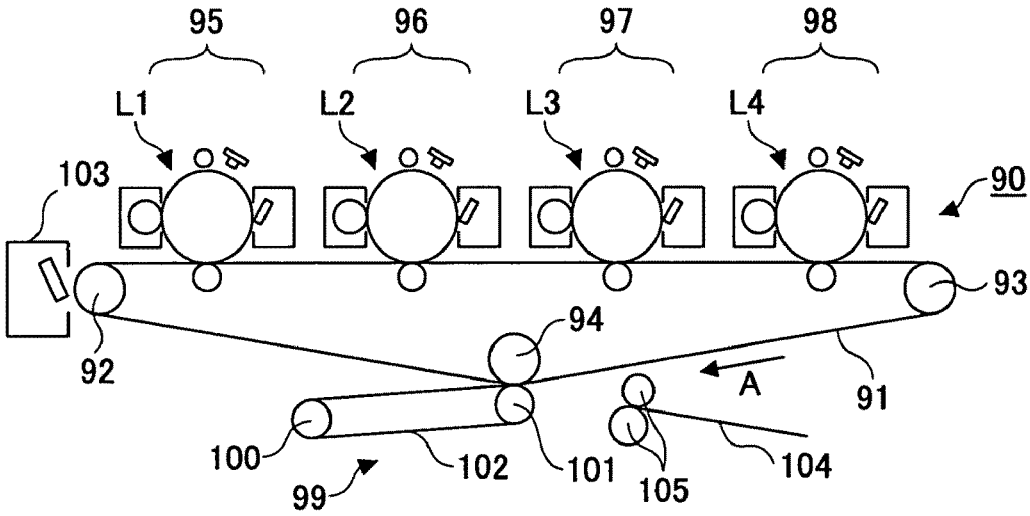
FIGS. 15A and 15B are schematic diagrams showing the configuration of an image forming apparatus in an embodiment of the present invention.
Figure 15B:
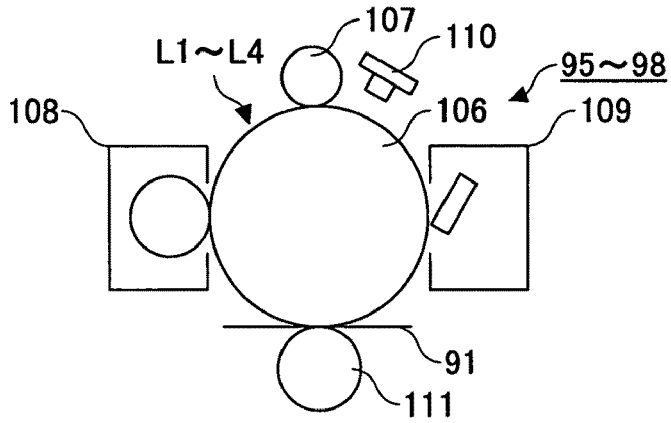

FIGS. 15A and 15B are schematic diagrams showing the configuration of an image forming apparatus according to an embodiment of the present inventions. The image forming apparatus shown in the figures may be a copying machine or a printer. FIG. 15A is a schematic diagram of the whole of a tandem-type color-electrophotographic image forming apparatus and FIG. 15B is a diagram showing the configuration of one image forming unit of the image forming apparatus shown in FIG. 15A.

An image forming apparatus 90 shown in FIGS. 15A and 15B has an intermediate transcription belt 91 as a toner image carrier. The intermediate transcription belt 91 is tensioned and extends on three supporting rollers 92, 93 and 94, and rotates to the direction of arrow A in the figure. Image forming units 95, 96, 97 and 98 for black, yellow, magenta and cyan, respectively, are arranged for the intermediate transcription belt 91. Above these image forming units, light-exposure devices are arranged which are not shown in the figures. For example, when the image forming apparatus is a copying machine, image information for an original copy is read by a scanner and lights L1, L2, L3 and L4 are emitted from the light-exposure devices, respectively, in order to write an electrostatic latent image on photoconductor drums in accordance with the image information. A secondary transcription device 99 is provided at a location at which it opposes the supporting roller 94 for the intermediate transcription belt 91 via the intermediate transcription belt 91. The secondary transcription device 99 is composed of a secondary transcription belt 102 which is tensioned and extends on two supporting rollers 100 and 101. Additionally, a transcription roller other than the transcription belt may be used for the secondary transcription device 99. Also, a belt cleaning device 103 is arranged at a location at which it opposes the supporting roller 92 for the intermediate transcription belt 91 via the intermediate transcription 91. The belt cleaning device 103 is arranged to eliminate a toner remaining on the intermediate transcription belt 91.

A recording paper sheet 104 as a recording medium is guided to a secondary transcription part by a pair of paper sheet feeding rollers 105, and a toner image is transcribed by pushing the secondary transcription belt 102 onto the intermediate transcription belt 91 when the toner image is transcribed on the recording paper sheet 104. The recording paper sheet 104 on which the toner image is transcribed is conveyed by the secondary transcription belt 102 and the unfixed toner image transcribed on the recording paper sheet 104 is fixed by a toner fixing device according to an embodiment of the present invention, which controls the thickness of a foam-like fixation fluid layer based on image information from an light exposure device which is not shown in the figure. That is, a foam-like fixation fluid according to an embodiment of the present invention which is supplied from the toner fixing device in which the layer thickness of a foam-like fixation fluid layer has been controlled based on image information, for example, a color image or a black solid image, from the light exposure devices which are not shown in the figure, is provided to the unfixed toner image transcribed on the recording paper sheet 104, and the unfixed toner image is fixed on the recording paper sheet 104 by an agent for dissolving or swelling at least one portion of a resin in the toner (a softening agent) which is contained in the foam-like fixation fluid.

Next, the image forming unit is described below. As shown in FIG. 15B, a charging device 107, a developing device 108, a cleaning device 109 and a charge eliminating device 110 are arranged around the photoconductor drum 106 in each of the image forming units 95, 96, 97 and 98. Also, a primary transcription device 111 is provided at a location at which it opposes the photoconductor drum 106 via the intermediate transcription belt 91. Also, the charging device 107 is a charging device in accordance with a contact charging method which uses a charging roller. The charging device 107 uniformly charges the surface of the photoconductor drum 106 by contacting the charging roller with the photoconductor drum 106 and applying a voltage to the photoconductor drum 106. For the charging device 107, a charging device in accordance with a non-contact charging method which uses, for example, a non-contact scorotron may be also used. Also, the developing device 108 makes a toner in a developer adhere to an electrostatic latent image on the photoconductor drum 106 so that the electrostatic latent image is visualized. Herein, each toner corresponding to each color is composed of a resin material colored with each color and the resin material may be dissolved or swelled by the fixation fluid according to an embodiment of the present invention. Additionally, the developing device 108 has an agitation part and developing part which are not shown in the figure and a developer which has not been used for development returns to the agitation part and is reused. The concentration of the toner in the agitation part is detected by a toner concentration sensor, which part is controlled such that the concentration of the toner is constant. Furthermore, the primary transcription device 111 transcribes the toner visualized on the photoconductor drum 106 to the intermediate transcription belt 91. Herein, for the primary transcription device 111, a transcription roller is used and the transcription roller is pushed onto the photoconductor drum 106 via the intermediary transcription belt 91. For the primary transcription device 111, for example, an electrically conductive brush and a non-contact corona charger may be also used. Also, the cleaning device 109 eliminates an unwanted toner on the photoconductor drum 106. For the cleaning device 109, a blade with an end which is pushed onto the photoconductor drum 106 may be used. Herein, the toner recovered by the cleaning device 109 is recovered into and reused in the developing device 108 by a recovering screw and toner recycle device which are not shown in the figure. The charge eliminating device 110 is composed of a lamp and initializes the surface electric potential of the photoconductor drum 106 by light irradiation.

Next, specific examples of a fixation fluid and fixation according to an embodiment of the present invention are described below.

Specific Example 1

Formulation of a Fixation Fluid

Liquid Containing a Softening Agent

Dilution solvent: Ion-exchanged water, 70% by weight

Softening agent: diethoxyethyl succinate (Croda Inc., Croda DES), 10% by weight

Thickening agent: glycerin, 5% by weight

Bubble-increasing agent: coconut oil fatty acid diethanolamide (Komikado DEA), 2% by weight Foaming agent: sodium palmitate, 5% by weight; sodium myristate, 3% by weight; and sodium stearate, 2% by weight Dispersing agent: POE (20) lauryl sorbitan (Kao corporation, RHEODOL TW-S120V), 2% by weight; and polyethyleneglycol monostearate (Kao EMANON 3199), 1% by weight Additionally, the dispersing agents were used to improve the solubility of the softening agent in the dilution solvent.

On the component ratios, first, a solution was prepared by mixing and agitating at a solution temperature of 90° C. except the softening agent. Then, the softening agent was mixed to prepare a fixation fluid in which the softening agent was dissolved (a formulated solution before foaming it). Additionally, the dispersing agents were additives for improving the solubility of, for example, the softening agent.

Enclosing in a High-Pressure Closed Container

Liquid containing a softening agent: 95% by weight

Gas which is in a gas phase under atmospheric pressure (LPG): 5% by weight

On the component ratios, they were mixed in a closed container having an actuator part for atmospheric releasing and a nozzle part and an O/W emulsion liquid in which the gas which was in a gas phase under atmospheric pressure was dispersed was prepared by agitation (wherein the softening agent was dissolved in the fixation fluid).

<Application Device>

As shown in FIG. 11, the prepared foam-like fixation fluid was supplied from the closed container to a blade. The gap between the blade and an application roller was set to two patterns, that is, 25 μm and 40 μm.

Pressurizing roller: aluminum roller (ϕ 30)

Application roller: SUS roller baking-coated with a PFA resin (ϕ 30)

Blade: SUS sheet

Paper sheet conveying speed: 200 mm/s

Loading between pressurizing roller and application roller: two patterns, that is, 10 N and 200 N at one side <Experimental Results>

Then, the foam-like fixation fluid ejected from the high-pressure closed container was supplied to the gap between the blade and the application roller through a tube. The bulk density of the foam-like fixation fluid was 0.07 g/cm$^3$.

Figure 16:
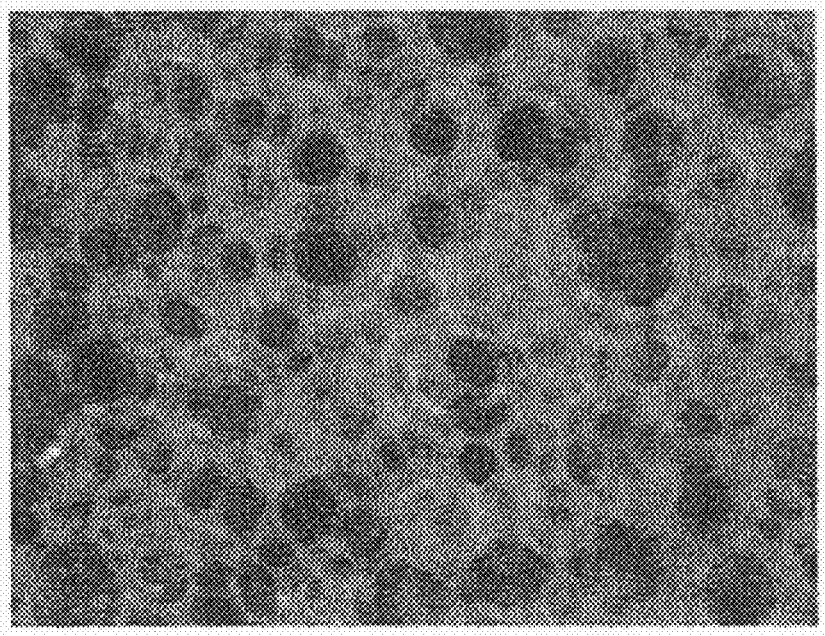
FIG. 16 is a schematic diagram showing a situation of air bubbles in a foam-like fixation fluid layer which air bubbles were observed by an optical microscope.
Figure 17A:
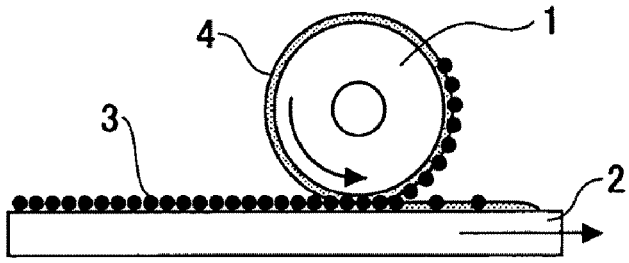
FIGS. 17A and 17B are schematic diagrams showing situations of fixation in a conventional fixation device.
Figure 17B:
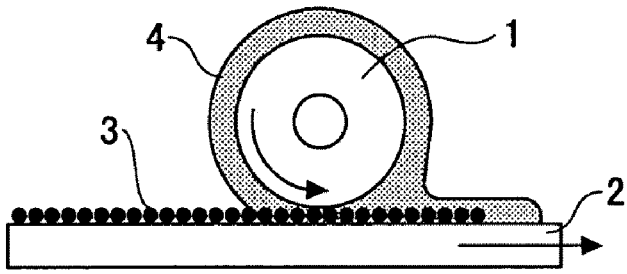

In FIG. 11, when the gap between the application roller and the blade was set to 25 μm or 40 μm, the fluid layer thickness and average bubble diameter of the foam-like fixation fluid on the application roller were as shown in Table. 1. Additionally, the fluid layer thickness was measured by a Doppler laser displacement meter and the average bubble diameter was obtained from a close-up photograph of the fluid layer on the application roller which was taken by an optical microscope, as shown in FIG. 16.

TABLE 1

| Blade Gap (μm) | Fluid Layer Thickness (μm) | Average Air Bubble Diameter (μm) |
|---|---|---|
| 25 | 20 | 18 (nearly monolayer) |
| 40 | 35 | 18 (nearly bilayer) |

Additionally, a significant bubble breaking in the foam-like fixation fluid was hardly found within a short time period (about 1 minute) during the observation of the surface of the application roller by the optical microscope.

Ipsio Color CX8800 (produced by Ricoh Company Ltd.) was used as a printer. Roller application was conducted on a PPC paper sheet (Ricoh T-6200) by using a fixation device as shown in FIG. 11, on which paper sheet a color image of unfixed toner had been formed, and after 10 seconds, the surface of the image was rubbed with a waste. Then, the degree of toner fixation on the PPC paper sheet was evaluated based on the presence or absence of toner adhering to the waste. Also, a mending tape was applied on the application roller after the application and the presence or absence of toner offset onto the application roller was determined based on the presence or absence of toner adhering to the mending tape. Furthermore, four-color gradation pattern was used as an image pattern and the presence or absence of an image irregularity such as image deletion and image loss was determined by visual observation. In regard to curling of the paper sheet, the case where the height of a corner of the paper sheet was equal to or greater than 20 mm was evaluated as no good.

Additionally, the criteria of the experimental results are as follows (Similar ones apply to another specific examples and a comparative example).

Fixation property (Optical density of the contaminant on the waste); ○: Optical density equal to or less than 0.3, Δ: Optical density from 0.3 to 0.5, X: Optical density equal to or greater than 0.5

Offset property (Adhesion of toner on tape in visual observation); ○: Almost no toner adhesion, Δ: Slight toner adhesion, X: Significant toner adhesion Presence or Absence of image irregularity; ○: Almost no irregularity or good, Δ: An irregularity(ies) on a portion of an image, X: Irregularities over the entire of an image Curling; ○: Equal to or less than 20 mm, Δ: From 20 mm to 30 mm, X: Equal to or greater than 30 mm The results of evaluations of the fixation property, offset property, presence or absence of an image irregularity, and curling of a paper sheet on the conditions of the foam-like fixation fluid in Table 1 are shown in Table 2 when the loading on the application roller at one side thereof was 10 N or 200 N.

TABLE 2

| Application Roller One-Side Loading (N) | Thickness of Fixation Fluid Layer on Application Roller (μM) | Fixation Property | Offset Property | Presence or Absence of Image Irregularity | Presence or Absence of Curling |
|---|---|---|---|---|---|
| 10 | 33 | ○ | Δ | Δ | ○ |
| 200 | 33 | ○ | ○ | ○ | ○ |
| 10 | 48 | ○ | ○ | ○ | ○ |
| 200 | 48 | ○ | Δ | Δ | ○ |

As seen from Table 2, extremely good fixation may be possible by appropriately controlling the layer thickness of a foam-like fixation fluid on an application roller depending on a pressure applied on the contact area between a recording medium and the application roller.

Specific Example 2

Formulation of a Fixation Fluid

Liquid Containing a Softening Agent

Dilution solvent: Ion-exchanged water, 70% by weight

Softening agent: diethoxyethyl succinate (Croda Inc., Croda DES), 10% by weight

Thickening agent: glycerin, 5% by weight

Bubble increasing agent: coconut oil fatty acid diethanolamide (Komikado DEA), 2% by weight Foaming agent: potassium palmitate, 5% by weight; potassium myristate, 3% by weight; and potassium stearate, 2% by weight Dispersing agent: POE (20) lauryl sorbitan (Kao corporation, RHEODOL TW-S120V), 2% by weight; and polyethyleneglycol monostearate (Kao EMANON 3199), 1% by weight On the component ratios, first, a solution was prepared by mixing and agitating at a solution temperature of 90° C. except the softening agent. Then, the softening agent was mixed to prepare a fixation fluid in which the softening agent was dissolved (a formulated solution before foaming it).

Enclosing in a High-Pressure Closed Container

Liquid containing a softening agent: 95% by weight

Gas which is in a gas phase under atmospheric pressure (LPG): 5% by weight

On the component ratios, they were mixed in a closed container having an actuator part for atmospheric releasing and a nozzle part and an O/W emulsion liquid in which the gas which was in a gas phase under atmospheric pressure was dispersed was prepared by agitation (wherein the softening agent was dissolved in the fixation fluid).

<Application Device>

Similarly to specific example 1, as shown in FIG. 11, the prepared foam-like fixation fluid was supplied from the closed container to a blade.

<Experimental Results>

Then, the foam-like fixation fluid ejected from the high-pressure closed container was supplied to the gap between the blade and an application roller through a tube. The bulk density of the foam-like fixation fluid was 0.09 g/cm$^3$.

In FIG. 11, when the gap between the application roller and the blade was set to 25 μm or 40 μm, the fluid layer thickness and average bubble diameter of the foam-like fixation fluid on the application roller, which were obtained by the same measurement methods as those of specific example 1, were as shown in Table. 3.

TABLE 3

| Blade Gap (μm) | Fluid Layer Thickness (μm) | Average Air Bubble Diameter (μm) |
|---|---|---|
| 25 | 20 | 18 (nearly monolayer) |
| 40 | 33 | 19 (nearly bilayer) |

Additionally, a significant bubble breaking in the foam-like fixation fluid was hardly found within a short time period (about 1 minute) during the observation of the surface of the application roller by an optical microscope.

Ipsio Color CX8800 (produced by Ricoh Company Ltd.) was used as a printer. Roller application was conducted on a PPC paper sheet (Ricoh T-6200) by using a fixation device as shown in FIG. 11, on which paper sheet a color image of unfixed toner had been formed, and the results of evaluations of the fixation property, offset property, presence or absence of an image irregularity, and curling of a paper sheet on the conditions of the foam-like fixation fluid in Table 3 are shown in Table 4.

TABLE 4

| Application Roller One-Side Loading (N) | Thickness of Fixation Fluid Layer on Application Roller (μM) | Fixation Property | Offset Property | Presence or Absence of Image Irregularity | Presence or Absence of Curling |
|---|---|---|---|---|---|
| 10 | 20 | ○ | Δ | Δ | ○ |
| 200 | 20 | ○ | ○ | ○ | ○ |
| 10 | 33 | ○ | ○ | ○ | ○ |
| 200 | 33 | ○ | Δ | Δ | ○ |

As seen from Table 4, extremely good fixation may be possible by appropriately controlling the layer thickness of a foam-like fixation fluid on an application roller depending on a pressure applied on the contact area between a recording medium and the application roller.

Specific Example 3

Formulation of a Fixation Fluid

Liquid Containing a Softening Agent

Dilution solvent: Ion-exchanged water, 66% by weight

Softening agent: diethoxyethyl succinate (Croda Inc., Croda DES), 10% by weight

Thickening agent: glycerin, 5% by weight

Bubble increasing agent: coconut oil fatty acid diethanolamide (Komikado DEA), 2% by weight Foaming agent: A fatty acid amine (a palmitic acid raw material, 5% by weight; a myristic acid raw material, 3% by weight; a stearic acid raw material, 2% by weight; and triethanolamine, 4% by weight), 14% by weight Dispersing agent: POE (20) lauryl sorbitan (Kao corporation, RHEODOL TW-S120V), 2% by weight; and polyethyleneglycol monostearate (Kao EMANON 3199), 1% by weight On the component ratios, first, ion-exchanged water in which the triethanolamine had preliminarily been dissolved was heated at a liquid temperature of 90° C. and the palmitic acid raw material, the myristic acid raw material, and the stearic acid raw material were added, respectively, so as to prepare the fatty acid amine which was a foaming agent. Subsequently, the residual components except the softening agent were mixed and agitated so as to prepare a solution. Then, the softening agent was mixed to prepare a fixation fluid in which the softening agent was dissolved (a formulated solution before foaming it).

Enclosing in a High-Pressure Closed Container

Liquid containing a softening agent: 95% by weight

Gas which is in a gas phase under atmospheric pressure (LPG): 5% by weight

On the component ratios, they were mixed in a closed container having an actuator part for atmospheric releasing and a nozzle part and an O/W emulsion liquid in which the gas which was in a gas phase under atmospheric pressure was dispersed was prepared by agitation (wherein the softening agent was dissolved in the fixation fluid).

<Application Device>

Similarly to specific example 1, as shown in FIG. 11, the prepared foam-like fixation fluid was supplied from the closed container to a blade.

<Experimental Results>

Then, the foam-like fixation fluid ejected from the high-pressure closed container was supplied to the gap between the blade and an application roller through a tube. The bulk density of the foam-like fixation fluid was 0.07 g/cm$^3$.

In FIG. 11, when the gap between the application roller and the blade was set to 25 μm or 40 μm, the fluid layer thickness and average bubble diameter of the foam-like fixation fluid on the application roller, which were obtained by the same measurement methods as those of specific example 1, were as shown in Table. 5.

TABLE 5

| Blade Gap (μm) | Fluid Layer Thickness (μm) | Average Air Bubble Diameter (μm) |
|---|---|---|
| 25 | 20 | 18 (nearly monolayer) |
| 40 | 33 | 19 (nearly bilayer) |

Additionally, a significant bubble breaking in the foam-like fixation fluid was hardly found within a short time period (about 1 minute) during the observation of the surface of the application roller by an optical microscope.

Ipsio Color CX8800 (produced by Ricoh Company Ltd.) was used as a printer. Roller application was conducted on a PPC paper sheet (Ricoh T-6200) by using a fixation device as shown in FIG. 11, on which paper sheet a color image of unfixed toner had been formed, and the results of evaluations of the fixation property, offset property, presence or absence of an image irregularity, and curling of a paper sheet on the conditions of the foam-like fixation fluid in Table 5 are shown in Table 6.

TABLE 6

| Application Roller One-Side Loading (N) | Thickness of Fixation Fluid Layer on Application Roller (μM) | Fixation Property | Offset Property | Presence or Absence of Image Irregularity | Presence or Absence of Curling |
|---|---|---|---|---|---|
| 10 | 20 | ○ | Δ | Δ | ○ |
| 200 | 20 | ○ | ○ | ○ | ○ |
| 10 | 33 | ○ | ○ | ○ | ○ |
| 200 | 33 | ○ | Δ | Δ | ○ |

As seen from Table 6, extremely good fixation may be possible by appropriately controlling the layer thickness of a foam-like fixation fluid on an application roller depending on a pressure applied on the contact area between a recording medium and the application roller.

Comparative Example

Formulation of a Fixation Fluid

Instead of the salt of fatty acid as a foaming agent, a polyoxyethylene-type surfactant which is a nonionic surfactant was used.

Liquid Containing a Softening Agent

Dilution solvent: Ion-exchanged water, 79% by weight

Softening agent: diethoxyethyl succinate (Croda Inc., Croda DES), 10% by weight

Thickening agent: glycerin, 5% by weight

Bubble increasing agent: coconut oil fatty acid diethanolamide (Komikado DEA), 2% by weight Foaming agent: polyoxyethylene-type surfactant (Nippon Oil & Fats Co., Ltd.), 1% by weight Dispersing agent: POE (20) lauryl sorbitan (Kao corporation, RHEODOL TW-S120V), 2% by weight; and polyethyleneglycol monostearate (Kao EMANON 3199), 1% by weight On the component ratios, first, a solution was prepared by mixing and agitating at a solution temperature of 25° C. except the softening agent. Then, the softening agent was mixed to prepare a fixation fluid in which the softening agent was dissolved (a formulated solution before foaming it).

Enclosing in a High-Pressure Closed Container

Liquid containing a softening agent: 95% by weight

Gas which is in a gas phase under atmospheric pressure (LPG): 5% by weight

On the component ratios, they were mixed in a closed container having an actuator part for atmospheric releasing and a nozzle part and an O/W emulsion liquid in which the gas which was in a gas phase under atmospheric pressure was dispersed was prepared by agitation (wherein the softening agent was dissolved in the fixation fluid).

<Application Device>

Similarly to specific examples 1, 2 and 3, as shown in FIG. 11, the prepared foam-like fixation fluid was supplied from the closed container to a blade.

<Experimental Results>

Then, the foam-like fixation fluid ejected from the high-pressure closed container was supplied to the gap between the blade and an application roller through a tube. The bulk density of the foam-like fixation fluid was 0.20 g/cm$^3$.

In FIG. 11, when the gap between the application roller and the blade was set to 25 μm or 40 μm, the fluid layer thickness and average bubble diameter of the foam-like fixation fluid on the application roller were as shown in Table. 7. Additionally, the measurements of the fluid layer thickness and average bubble diameter were the same measurements as those of specific example 1.

TABLE 7

| Blade Gap (μm) | Fluid Layer Thickness (μm) | Average Air Bubble Diameter (μm) |
|---|---|---|
| 25 | 20 | 20 (monolayer) |
| 40 | 35 | 21 (nearly bilayer) |

Additionally, bubbles were successively subjected to bubble breaking within a short time period (about 1 minute) during the observation thereof by a microscope and foaming stability was not good.

Similarly to specific example 1, Ipsio Color CX8800 (produced by Ricoh Company Ltd.) was used as a printer. Roller application was conducted on a PPC paper sheet (Ricoh T-6200) by using a fixation device as shown in FIG. 11, on which paper sheet a color image of unfixed toner had been formed, and the fixation property, offset property, presence or absence of an image irregularity, and curling of a paper sheet on the conditions of the foam-like fixation fluid in Table 7 were evaluated. The results thereof are shown in Table 8.

TABLE 8

| Application Roller One-Side Loading (N) | Thickness of Fixation Fluid Layer on Application Roller (μM) | Fixation Property | Offset Property | Presence or Absence of Image Irregularity | Presence or Absence of Curling |
|---|---|---|---|---|---|
| 10 | 20 | ○ | X | X | X |
| 200 | 20 | ○ | X~Δ | Δ | X |
| 10 | 35 | ○ | X~Δ | Δ | X |
| 200 | 35 | ○ | X | X | X |

As seen from Table 8, in the case of a foam-like fixation fluid including a foaming agent except salts of fatty acids, a significant offset, image irregularity or paper sheet curling was caused even if the layer thickness of the foam-like fixation fluid on an application roller was changed depending on a pressure applied on the contact area between a recording medium and the application roller.

Specific Example 4

Formulation of a Fixation Fluid

Liquid Containing a Softening Agent

Dilution solvent: Ion-exchanged water, 70% by weight

Softening agent: diethoxyethyl succinate (Croda Inc., Croda DES), 10% by weight

Thickening agent: glycerin, 5% by weight

Bubble increasing agent: coconut oil fatty acid diethanolamide (Komikado DEA), 2% by weight Foaming agent: potassium palmitate, 5% by weight; potassium myristate, 3% by weight; and potassium stearate, 2% by weight Dispersing agent: POE (20) lauryl sorbitan (Kao corporation, RHEODOL TW-S120V), 2% by weight; and polyethyleneglycol monostearate (Kao EMANON 3199), 1% by weight On the component ratios, first, a solution was prepared by mixing and agitating at a solution temperature of 90° C. except the softening agent. Then, the softening agent was mixed to prepare a fixation fluid in which the softening agent was dissolved (a formulated solution before foaming it).

<Application Device>

As shown in FIGS. 12A and 12B, after a foam-like fixation fluid was prepared by sufficient agitation using an agitation wing in a closed container, the foam-like fixation fluid was supplied from a supplying pad to an application roller while pressurizing it. A wire bar was provided on the application roller so as to control the fluid layer. A wire diameter of 0.1 mm or 0.2 mm was used. For the agitation wing, a wing obtained by bundling wires, such as a whipper, was used.

<Experimental Results>

The number of revolution for the agitation was 3,000 rpm and the agitation time period was 1 minute. Then, the bulk density of the foam-like fixation fluid was 0.10 g/cm$^3$.

In FIGS. 12A and 12B, when the wire diameter of the wire bar was set to 0.1 mm or 0.2 mm, the fluid layer thickness and average bubble diameter of the foam-like fixation fluid on the application roller were as shown in Table. 9.

TABLE 9

| Wire Diameter (mm) | Fluid Layer Thickness (μm) | Average Air Bubble Diameter (μm) |
|---|---|---|
| 0.1 | 25 | 20 (monolayer) |
| 0.2 | 40 | 42 (bilayer) |

Additionally, a bubble breaking in the foam-like fixation fluid was hardly found within a short time period (about 1 minute) during the observation of the surface of the application roller by an optical microscope.

Ipsio Color CX8800 (produced by Ricoh Company Ltd.) was used as a printer. Roller application was conducted on a PPC paper sheet (Ricoh T-6200) by using a fixation device as shown in FIGS. 12A and 12B, on which paper sheet a color image of unfixed toner had been formed, and the results of evaluations of the fixation property, offset property, presence or absence of an image irregularity, and curling of a paper sheet on the conditions of the foam-like fixation fluid in Table 9 are shown in Table 10.

TABLE 10

| Application Roller One-Side Loading (N) | Thickness of Fixation Fluid Layer on Application Roller (μM) | Fixation Property | Offset Property | Presence or Absence of Image Irregularity | Presence or Absence of Curling |
|---|---|---|---|---|---|
| 10 | 25 | ○ | Δ | Δ | ○ |
| 200 | 25 | ○ | ○ | ○ | ○ |
| 10 | 40 | ○ | ○ | ○ | ○ |
| 200 | 40 | ○ | Δ | Δ | ○ |

As seen from Table 10, extremely good fixation may be possible by appropriately controlling the layer thickness of a foam-like-fixation fluid on an application roller depending on a pressure applied on the contact area between a recording medium and the application roller.

Specific Example 5

Formulation of a Fixation Fluid

Liquid Containing a Softening Agent

Dilution solvent: Ion-exchanged water, 58% by weight

Softening agent: diisobutyl adipate (Higher. Alcohol Industry Co., Ltd., KAK-DiBA), 7% by weight Thickening agent: glycerin, 20% by weight Bubble increasing agent: coconut oil fatty acid diethanolamide (Komikado DEA), 2% by weight Foaming agent: potassium palmitate, 5% by weight; potassium myristate, 3% by weight; and potassium oleate, 2% by weight Dispersing agent: POE (20) lauryl sorbitan (Kao corporation, RHEODOL TW-S120V), 2% by weight; and polyethyleneglycol monostearate (Kao EMANON 3199), 1% by weight On the component ratios, first, a solution was prepared by mixing and agitating at a solution temperature of 90° C. except the softening agent. Then, the softening agent was mixed to prepare a fixation fluid in which the softening agent was dissolved (a formulated solution before foaming it).

<Application Device>

As shown in FIGS. 12A and 12B, after a foam-like fixation fluid was prepared by sufficient agitation using an agitation wing in a closed container, the foam-like fixation fluid was supplied from a supplying pad to an application roller while pressurizing it. A wire bar was provided on the application roller so as to control the fluid layer. A wire diameter of 0.1 mm or 0.2 mm was used. For the agitation wing, a wing obtained by bundling wires, such as a whipper, was used.

<Experimental Results>

The number of revolution for the agitation was 3,000 rpm and the agitation time period was 1 minute. Then, the bulk density of the foam-like fixation fluid was 0.12 g/cm$^3$.

In FIGS. 12A and 12B, when the wire diameter of the wire bar was set to 0.1 mm or 0.2 mm, the fluid layer thickness and average bubble diameter of the foam-like fixation fluid on the application roller were as shown in Table. 11.

TABLE 11

| Wire Diameter (mm) | Fluid Layer Thickness (μm) | Average Air Bubble Diameter (μm) |
|---|---|---|
| 0.1 | 25 | 20 (monolayer) |
| 0.2 | 40 | 42 (bilayer) |

Additionally, a bubble breaking in the foam-like fixation fluid was hardly found within a short time period (about 1 minute) during the observation of the surface of the application roller by an optical microscope.

Ipsio Color CX8800 (produced by Ricoh Company Ltd.) was used as a printer. Roller application was conducted on a PPC paper sheet (Ricoh T-6200) by using a fixation device as shown in FIGS. 12A and 12B, on which paper sheet a color image of unfixed toner had been formed, and the results of evaluations of the fixation property, offset property, presence or absence of an image irregularity, and curling of a paper sheet on the conditions of the foam-like fixation fluid in Table 11 are shown in Table 12.

TABLE 12

| Application Roller One-Side Loading (N) | Thickness of Fixation Fluid Layer on Application Roller (μM) | Fixation Property | Offset Property | Presence or Absence of Image Irregularity | Presence or Absence of Curling |
|---|---|---|---|---|---|
| 10 | 25 | ○ | Δ | Δ | ○ |
| 200 | 25 | ○ | ○ | ○ | ○ |
| 10 | 40 | ○ | ○ | ○ | ○ |
| 200 | 40 | ○ | Δ | Δ | ○ |

As seen from Table 12, extremely good fixation may be possible by appropriately controlling the layer thickness of a foam-like fixation fluid on an application roller depending on a pressure applied on the contact area between a recording medium and the application roller.

APPENDIX

Typical embodiments (1) to (29) of the present invention are described below.

One of the typical embodiments of the present invention relates to one selected from the group consisting of a fixation device, a fixation method, an image formation apparatus, an image forming method, and a fixation fluid. More particularly, one of the typical embodiments of the present invention may relates to a fixation fluid configured to fix on a medium a fine particle which contains a resin or a device configured to fix a toner which is a fine particle that contains a resin.

Embodiment (1) is a fixation device configured to fix on a medium a resin fine particle that contains a resin, by providing a fixation fluid on the resin fine particle on the medium which fixation fluid contains a softening agent that softens the resin fine particle by dissolving or swelling at least one portion of the resin, water and a foaming agent that comprises a salt of aliphatic acid, wherein the fixation device comprises a foam-like fixation fluid producing part configured to produce a foam-like fixation fluid, a layer thickness controlling part configured to control a layer thickness of the produced foam-like fixation fluid, and a provision part configured to provide the layer-thickness-controlled foam-like fixation fluid on the resin fine particle on the medium.

Herein, the embodiment (1) as described above makes it possible to prevent offset onto a member of the provision part (e.g. in contact provision), to attain a small amount provision without disturbing a resin fine particle on a medium, and/or to provide fixation in which curling of a recording medium such as a paper sheet is not easy to occur and which is excellent in fixation responsibility.

Embodiment (2) is the fixation device as described in embodiment (1) above, wherein the foam-like fixation fluid producing part is configured to apply a shearing force to the fixation fluid so as to contain an air bubble in the fixation fluid and produce the foam-like fixation fluid.

Herein, embodiment (2) makes it possible to produce a stable foam-like fixation fluid to improve reliability.

Embodiment (3) is the fixation device as described in embodiment (1) above, wherein the foam-like fixation fluid producing part comprises a closed container in which a fixation fluid that contains an atmospheric component or an alkane that is gas under atmospheric pressure is closed under atmospheric or higher pressure, an actuator member configured to release the fixation fluid to atmosphere, and a nozzle member configured to eject the fixation fluid.

Herein, embodiment (3) makes it possible to produce a foam-like fixation fluid easily without using a mechanical apparatus so as to miniaturize the device or to attain weight-saving thereof.

Embodiment (4) is the fixation device as described in embodiment (1) above, wherein the layer thickness controlling part configured to control a layer thickness of the foam-like fixation fluid depending on a contact pressure in a case where the provision part is a direct provision part configured to provide the foam-like fixation fluid to the medium such that it contacts the medium.

Herein, embodiment (4) makes it possible to adjust a contact pressure of the direct provision part so as to control a layer thickness of a foam-like fixation fluid to be in an appropriate range, whereby a fixation device may be provided in which fixation that causes no offset and is excellent in fixation responsibility is allowed.

Embodiment (5) is the fixation device as described in embodiment (1) or (4) above, wherein the layer thickness controlling part is configured to control a layer thickness of the foam-like fixation fluid depending on a thickness of a layer of the resin fine particle on the medium.

Herein, embodiment (5) makes it possible to provide a fixation device in which fixation that causes no offset and is excellent in fixation responsibility is allowed.

Embodiment (6) is the fixation device as described in any of embodiments (1) through (5) above, wherein the provision part is an application roller.

Herein, the embodiment (6) provides a more preferable fixation device.

Embodiment (7) is the fixation device as described in any of embodiments (1) through (5) above, wherein the provision part is an application belt.

Herein, the embodiment (7) provides a more preferable fixation device.

Embodiment (8) is a fixation method configured to fix on a medium a resin fine particle that contains a resin, by producing a fixation fluid in a foam-like condition which fixation fluid contains a softening agent that softens the resin fine particle by dissolving or swelling at least one portion of the resin, water and a foaming agent that comprises a salt of aliphatic acid, and controlling a layer thickness of a produced foam-like fixation fluid while it is provided on the resin fine particle on the medium.

Herein, the embodiment (8) as described above makes it possible to disturb no resin fine particle that contains a resin, such as a toner, on a medium, such as a paper sheet, and/or to quickly conduct fixation of a resin fine particle on a medium after applying a fixation fluid on the medium to which the resin fine particle adheres, whereby reliability of fixation may be improved.

Embodiment (9) is the fixation method as described in embodiment (8) above, wherein a shearing force is applied to the fixation fluid so as to contain an air bubble in the fixation fluid and produce the foam-like fixation fluid.

Herein, embodiment (9) makes it possible to produce a stable foam-like fixation fluid to improve reliability.

Embodiment (10) is the fixation method as described in embodiment (8) above, wherein a fixation fluid that contains an atmospheric component or an alkane that is gas under atmospheric pressure is closed under atmospheric or higher pressure and the fixation fluid is released to atmosphere, so as to produce a foam-like fixation fluid.

Herein, embodiment (10) makes it possible to produce a foam-like fixation fluid easily without using a mechanical apparatus so as to miniaturize the device or to attain weight-saving thereof.

Embodiment (11) is the fixation method as described in embodiment (8) above, wherein a layer thickness of the foam-like fixation fluid is controlled depending on a contact pressure in a case where the foam-like fixation fluid is provided to the medium such that it contacts the medium.

Herein, embodiment (11) makes it possible to control a layer thickness of a foam-like fixation fluid to be in an appropriate range, depending on the contact pressure, whereby a fixation device may be provided in which fixation that causes no offset and is excellent in fixation responsibility is allowed.

Embodiment (12) is the fixation method as described in embodiment (8) or (11) above, wherein a layer thickness of the foam-like fixation fluid is controlled depending on a thickness of a layer of the resin fine particle on the medium.

Herein, embodiment (12) makes it possible to allow for fixation that causes no offset and is excellent in fixation responsibility.

Embodiment (13) is an image forming apparatus which comprises an image forming part configured to form an unfixed toner image on a medium by conducting an electrostatic recording process with a toner in which a resin fine particle contains a coloring agent, and a fixation part configured to fix the unfixed toner image on the medium, with the fixation device as described in any of embodiments (1) through (7).

Herein, embodiment (13) makes it possible to provide an image forming apparatus to disturb no fine particle that contains a resin, such as a toner, on a medium, such as a paper sheet, to quickly conduct fixation of a resin fine particle on a medium after applying a fixation fluid on the medium to which the resin fine particle adheres, to allow for a small amount of application such that residual liquid feeling is not caused on a medium, to attain non-heating fixation and low electric power consumption, and/or to be in excellent in fixation responsibility.

Embodiment (14) is an image forming method in which an electrostatic recording process is conducted with a toner in which a resin fine particle contains a coloring agent to form an unfixed toner image on a medium, and the unfixed toner image is fixed on the medium, with the fixation method as described in any of embodiments (8) through (12), so as to form an image on the medium.

Herein, embodiment (14) makes it possible to provide an image forming method which attains non-heating-type fixation and low electric power consumption, and/or is in excellent in fixation responsibility.

Embodiment (15) is a fixation fluid configured to fix a resin fine particle on a medium by producing the fixation fluid in a foam-like condition and providing the produced foam-like fixation fluid on the resin fine particle on the medium, the fixation fluid contains a softening agent that softens the resin fine particle by dissolving or swelling at least one portion of the resin fine particle, water and a foaming agent that comprises a salt of aliphatic acid.

Herein, embodiment (15) makes it possible to make an air bubble of a foam-like fixation fluid be smaller, to form an air bubble layer which is excellent in foaming stability and/or suppresses permeation of a fixation fluid to a paper sheet, to make the amount of a fixation fluid applied on a paper sheet as a recording medium be a slight amount thereof, to suppress curling of a paper sheet as a recording medium, and/or to improve fixation responsibility.

Embodiment (16) is the fixation fluid as described in embodiment (15) above, wherein the fixation fluid contains a bubble increasing agent.

Embodiment (17) is the fixation fluid as described in embodiment (16), wherein the bubble increasing agent contains an aliphatic acid-derived alkanolamide-type nonionic surfactant.

Herein, at least one of embodiments (16) and (17) above makes it possible to improve foaming stability so as to suppresses bubble breaking of a foam-like fixation fluid at an area at which a contact application part contacts a recording medium such as a paper sheet, whereby toner offset may be prevented which is caused by bubble breaking and liquefaction of the fixation fluid.

Embodiment (18) is the fixation fluid as described in embodiment (15) above, wherein the salt of aliphatic acid is a single one of, or a mixture of at least one of, salts of saturated aliphatic acids whose carbon numbers are 12, 14, 16 and 18.

Herein, embodiment (18) makes it possible to provide a foam-like fixation fluid whose bubble plateau area is robust and/or to improve foaming stability so as to suppresses bubble breaking of a foam-like fixation fluid at an area at which a contact application part contacts a recording medium such as a paper sheet, whereby toner offset may be prevented which is caused by bubble breaking and liquefaction of the fixation fluid.

Embodiment (19) is the fixation fluid as described in embodiment (15) above, wherein the salts of aliphatic acids comprise a single one of, or a mixture of at least one of, salts of unsaturated aliphatic acids whose carbon numbers are 18 and double-bond numbers are at least one of 1 through 3.

Herein, embodiment (19) makes it possible to improve solubility of the salt of aliphatic acid in water under the environment of low air temperature equal to or less than 20° C. and/or to have an excellent foaming property in a range of a lower air temperature of 5° C.-15° C. to a higher air temperature of 35° C.-45° C., whereby fixation may be stably conducted in a wide range of environmental temperature.

Embodiment (20) is the fixation fluid as described in any of embodiments (15)-(19) above, wherein the salt of aliphatic acid is a sodium salt, a potassium salt, or an amine salt.

Herein, embodiment (19) makes it possible to maintain the solubility in water and/or to conduct fixation stably in a wide range of environmental temperature.

Embodiment (21) is the fixation fluid as described in any of embodiments (15) through (20) above, wherein the fixation fluid contains an atmospheric component or an alkane that is gas under atmospheric pressure is closed under atmospheric or higher pressure.

Herein, embodiment (21) makes it possible to allow for use of a high-pressure closed container and/or to allow for manufacturing of a foam-like fixation fluid that contains a dense and fine air bubble, by dissolving or dispersing a gas which is in a gas phase under atmospheric or less pressure or an atmospheric component in a fixation fluid.

Embodiment (22) is the fixation fluid as described in any of embodiments (15) to (21) above, wherein the softening agent comprises an aliphatic ester.

Herein, embodiment (22) makes it possible to provide a more preferable fixation fluid.

Embodiment (23) is the fixation fluid as described in embodiment (22) above, wherein the aliphatic ester comprises a saturated aliphatic ester.

Herein, embodiment (23) makes it possible to provide a more preferable fixation fluid.

Embodiment (24) is the fixation fluid as described in embodiment (23) above, wherein the saturated aliphatic ester comprises a compound represented by a general formula of $R_1COOR_2$, wherein $R_1$ is an alkyl group whose carbon number is equal to or greater than 11 and equal to or less than 14 and $R_2$ is an alkyl group whose carbon number is equal to or greater than 1 and equal to or less than 6.

Herein, embodiment (24) makes it possible to provide a more preferable fixation fluid.

Embodiment (25) is the fixation fluid as described in embodiment (22) above, wherein the aliphatic ester comprises an aliphatic dicarboxylic acid ester.

Herein, embodiment (25) makes it possible to provide a more preferable fixation fluid.

Embodiment (26) is the fixing fluid as described in embodiment (25) above, wherein the aliphatic dicarboxylic acid ester comprises a compound represented by a general formula of $R_3(COOR_4)_2$, wherein $R_3$ is an alkylene group whose carbon number is equal to or greater than 3 and equal to or less than 8 and $R_4$ is an alkyl group whose carbon number is equal to or greater than 3 and equal to or less than 5.

Herein, embodiment (26) makes it possible to provide a more preferable fixation fluid.

Embodiment (27) is the fixation fluid as described in embodiment (22) above, wherein the aliphatic ester comprises a dialkoxyalkyl aliphatic dicarboxylate.

Herein, embodiment (27) makes it possible to provide a more preferable fixation fluid.

Embodiment (28) is the fixation fluid as described in embodiment (27) above, wherein the dialkoxyalkyl aliphatic dicarboxylate comprises a compound represented by a general formula of $R_5(COOR_6—O—R_7)_2$, wherein $R_5$ is an alkylene group whose carbon number is equal to or greater than 2 and equal to or less than 8, $R_6$ is an alkylene group whose carbon number is equal to or greater than 2 and equal to or less than 4, and $R_7$ is an alkyl group whose carbon number is equal to or greater than 1 and equal to or less than 4.

Herein, embodiment (28) makes it possible to provide a more preferable fixation fluid.

Embodiment (29) is the fixation fluid as described in any of embodiments (15) through (28) above, wherein the fixation fluid comprises a monohydric or polyhydric alcohol.

Herein, embodiment (29) makes it possible to suppress curling of a recording medium such as a paper sheet which contains cellulose.

Additionally, at least one of the typical embodiments of the present invention may be based on an insight or principle such that a foam-like fluid which contains a large quantity of air bubbles may have a significantly low bulk density and/or the influence of the surface tension of a fluid surface or the internal flow property of a fluid, which are properties of a fluid may be significantly reduced by containing a large quantity of air bubbles.

Thus, the typical embodiments of the present invention may provide a fixation fluid for a resin fine particle and a fixation device, fixation method, image forming apparatus and image forming method using the fixation fluid, which fixation fluid makes it possible to disturb no fine particle that contains a resin, such as a toner, on a recording medium, such as a paper sheet, to quickly conduct fixation of a resin fine particle on a medium after applying the fixation fluid on the medium to which the resin fine particle adheres, and/or to attain small amount application such that residual liquid feeling is not caused on a medium.

Although the embodiments and practical examples of the present invention have been specifically described above, the present invention is not limited to the embodiments or practical examples and any of the embodiments or practical examples may be varied or modified without departing from the spirit and scope of the present invention.

The present application claims the benefit of the foreign priority based on Japanese Patent Application No. 2006-234735 filed on Aug. 31, 2006, the entire contents of which are hereby incorporated by reference.

What is claimed is:

1. A fixation device configured to fix on a medium a resin fine particle that contains a resin, by providing a fixation fluid on the resin fine particle on the medium which fixation fluid contains a softening agent that softens the resin fine particle by dissolving or swelling at least one portion of the resin, water and a foaming agent that comprises a salt of aliphatic acid, wherein the fixation device comprises a foam fixation fluid producing part configured to produce a foam fixation fluid~a layer thickness controlling part configured to control a layer thickness of the produced foam fixation fluid, and a provision part configured to provide the layer-thickness controlled foam fixation fluid on the resin fine particle on the medium.

2. The fixation device as claimed in claim 1, wherein the foam fixation fluid producing part is configured to apply a shearing force to the fixation fluid so as to contain an air bubble in the fixation fluid and produce the foam fixation fluid.

3. The fixation device as claimed in claim 1, wherein the foam fixation fluid producing part comprises a closed container in which a fixation fluid that contains an atmospheric component or an alkane that is gas under atmospheric pressure is closed under atmospheric or higher pressure, an actuator member configured to release the fixation fluid to atmosphere, and a nozzle member configured to eject the fixation fluid.

4. The fixation device as claimed in claim 1, wherein the layer thickness controlling part is configured to control a layer thickness of the foam fixation fluid depending on a contact pressure in a case where the provision part is a direct provision part configured to provide the foam fixation fluid to the medium such that it contacts the medium.

5. The fixation device as claimed in claim 1, wherein the layer thickness controlling part is configured to control a layer thickness of the foam fixation fluid depending on a thickness of a layer of the resin fine particle on the medium.

6. An image forming apparatus which comprises an image forming part configured to form an unfixed toner image on a medium by conducting an electrostatic recording process with a toner in which a resin fine particle contains a coloring agent, and a fixation part configured to fix the unfixed toner image on the medium, with the fixation device as claimed in claim 1.

7. A fixation fluid configured to fix a resin fine particle on a medium by producing the fixation fluid in a foam condition and providing the produced foam fixation fluid on the resin fine particle on the medium, wherein the fixation fluid contains a softening agent that softens the resin fine particle by dissolving or swelling at least one portion of the resin fine particle, water and a foaming agent that comprises a salt of aliphatic acid.

8. The fixation fluid as claimed in claim 7, wherein the fixation fluid contains a bubble increasing agent.

9. The fixation fluid as claimed in claim 8, wherein the bubble increasing agent contains an aliphatic acid-derived alkanolamide-type nonionic surfactant.

10. The fixation fluid as claimed in claim 7, wherein the salt of aliphatic acid is a single one of, or a mixture of at least one of, salts of saturated aliphatic acids whose carbon numbers are 12, 14, 16 and 18.

11. The fixation fluid as claimed in claim 7, wherein the salts of aliphatic acids comprise a single one of, or a mixture of at least one of, salts of unsaturated aliphatic acids whose carbon numbers are 18 and double-bond numbers are at least one of 1 through 3.

12. The fixation fluid as claimed in claim 7, wherein the salt of aliphatic acid is a sodium salt, a potassium salt, or an amine salt.

13. The fixation fluid as claimed in claim 7, wherein the fixation fluid contains an atmospheric component or an alkane that is gas under atmospheric pressure is closed under atmospheric or higher pressure.

14. The fixation fluid as claimed in claim 7, wherein the softening agent comprises an aliphatic ester.

15. The fixation fluid as claimed in claim 14, wherein the aliphatic ester comprises a saturated aliphatic ester.

16. The fixation fluid as claimed in claim 15, wherein the saturated aliphatic ester comprises a compound represented by a general formula of $R_1COOR_2$, wherein $R_1$ is an alkyl group whose carbon number is equal to or greater than 11 and equal to or less than 14 and $R_2$ is an alkyl group whose carbon number is equal to or greater than 1 and equal to or less than 6.

17. The fixation fluid as claimed in claim 14, wherein the aliphatic ester comprises an aliphatic dicarboxylic acid ester.

18. The fixing fluid as claimed in claim 17, wherein the aliphatic dicarboxylic acid ester 5 comprises a compound represented by a general formula of $R_3(COOR^4)_2$, wherein $R_3$ is an alkylene group whose carbon number is equal to or greater than 3 and equal to or less than 8 and $R_4$ is an alkyl group whose carbon number is equal to or greater than 3 and equal to or less than 5.

19. The fixation fluid as claimed in claim 14, wherein the aliphatic ester comprises a dialkoxyalkyl aliphatic dicarboxylate.

20. The fixation fluid as claimed in claim 19, wherein the dialkoxyalkyl aliphatic dicarboxylate comprises a compound represented by a general formula 25 of $R_5(COOR_6—O—R_7)_2$, wherein $R_5$ is an alkylene group whose carbon number is equal to or greater than 2 and equal to or less than 8, $R_6$ is an alkylene group whose carbon number is equal to or greater than 2 and equal to or less than 4, and R7 is an alkyl group whose carbon number is equal to or greater than 1 and equal to or less than 4.

* * * * *